US011085251B2

(12) United States Patent
Lloyd

(10) Patent No.: US 11,085,251 B2
(45) Date of Patent: Aug. 10, 2021

(54) CASING GUIDE AND CLAMP ASSEMBLY

(71) Applicant: Peter Lloyd, Ontario (CA)

(72) Inventor: Peter Lloyd, Ontario (CA)

(73) Assignee: Automated Recycling Systems, Inc., Mississauga (CA)

( * ) Notice: Subject to any disclaimer, the term of this patent is extended or adjusted under 35 U.S.C. 154(b) by 208 days.

(21) Appl. No.: 16/440,548

(22) Filed: Jun. 13, 2019

(65) Prior Publication Data

US 2020/0392799 A1 Dec. 17, 2020

(51) Int. Cl.
*E21B 19/12* (2006.01)
*E21B 19/24* (2006.01)

(52) U.S. Cl.
CPC ..... *E21B 19/12* (2013.01); *E21B 19/24* (2013.01)

(58) Field of Classification Search
CPC ..... E21B 19/12; E21B 19/24
USPC ..... 166/77.51
See application file for complete search history.

(56) References Cited

U.S. PATENT DOCUMENTS 7,527,093 B2 5/2009 Mosing
2008/0202813 A1* 8/2008 Anthony ..... E21B 19/14 175/52

* cited by examiner

*Primary Examiner* — Matthew R Buck
*Assistant Examiner* — Patrick F Lambe
(74) *Attorney, Agent, or Firm* — Michael P. Mazza; Michael P. Mazza, LLC

(57) ABSTRACT

An apparatus and method for use in the initial positioning, guiding, clamping and removal of a tubular casing used to produce a borehole, including a mainframe with an opening configured to receive, clamp onto and centralize the casing within the mainframe opening.

23 Claims, 15 Drawing Sheets

3rd Pivot Link (12)
2nd Pivot Link (11)
1st Pivot Link (10)

DETAIL A
A

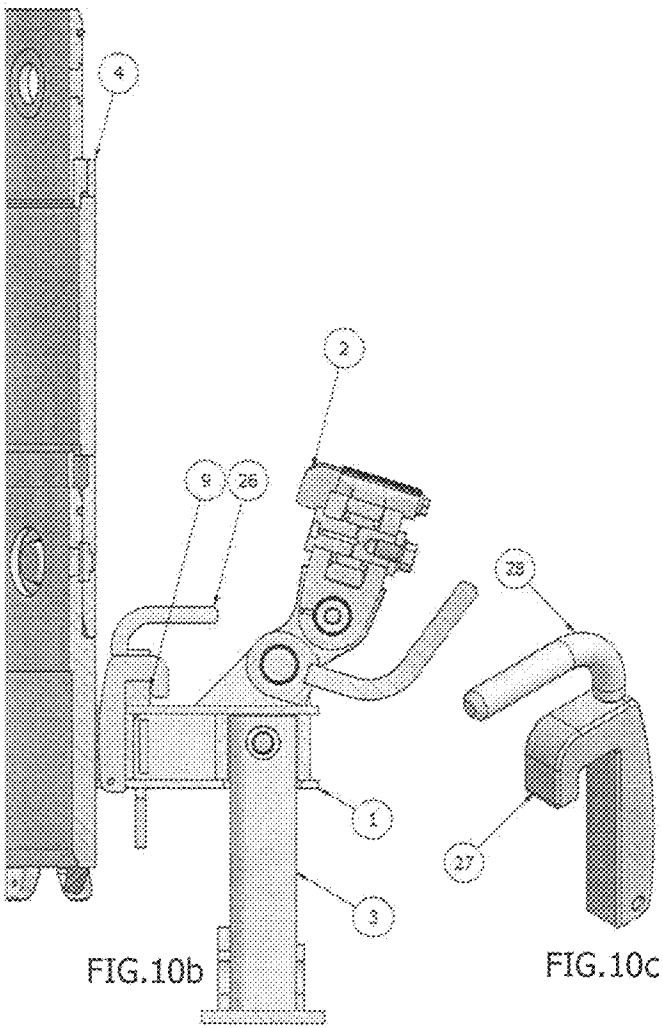
FIG.10b
FIG.10c
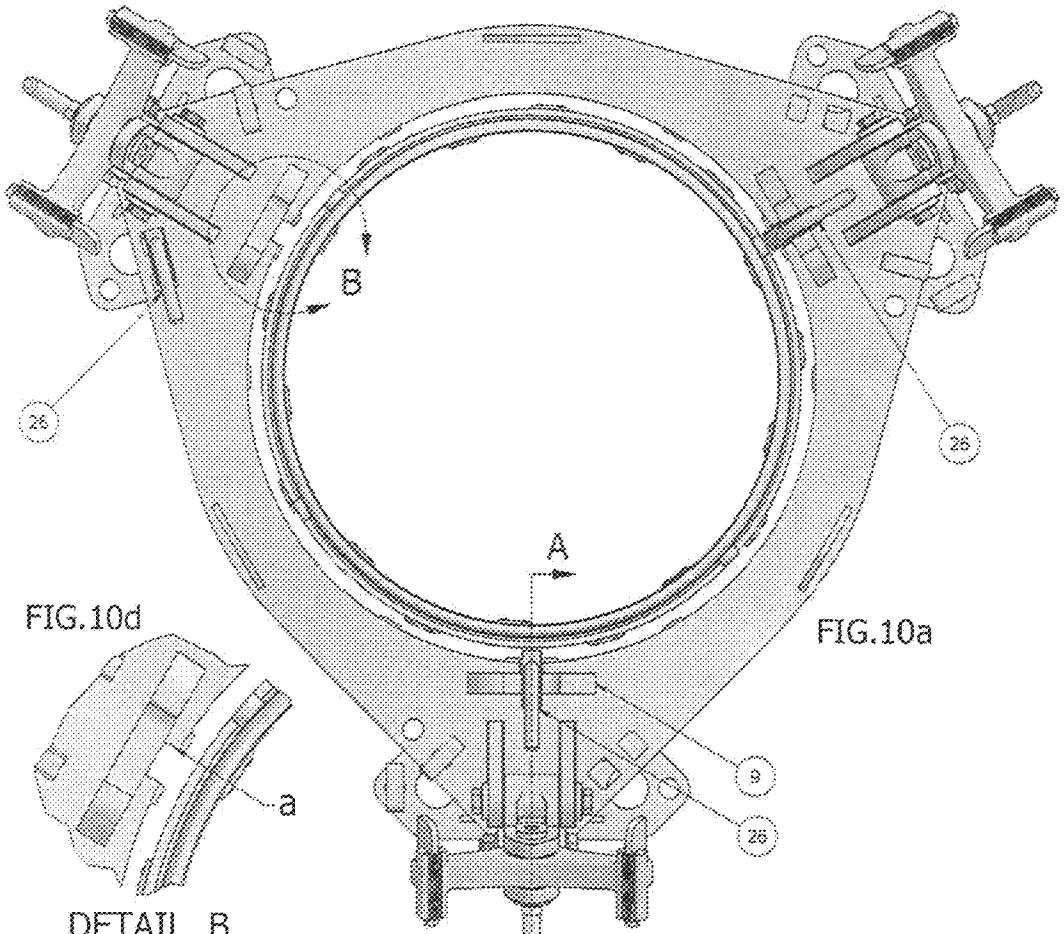
FIG.10a
FIG.10d

A
B
C

SECTION A-A

SECTION B-B

SECTION C-C

CASING GUIDE AND CLAMP ASSEMBLY

BACKGROUND OF THE INVENTION

The present invention generally relates to a mechanical guide and clamp assembly used primarily for aligning and holding (clamping) reusable sectional casings that are used for drilling subterranean boreholes.

As described later, the holding function prevents a string of casings from slipping back into the borehole when casing sections are being removed. The guide/clamp assembly is well suited for construction sites that generally have harsh operating environments such as, unstable and uneven footing, mud, standing water and freezing climatic conditions.

The following description will focus primarily on the use of a three-gripper arm with a guide/clamp assembly and reusable sectional casings ranging in outside diameters from 620 mm to 2500 mm. Sectional casings are generally manufactured in single or double wall construction and feature a male joint on one end, and a female joint on the other. Sectional casings are reusable and are widely used in the construction of concrete piles and secant walls (intersecting concrete soldier and filler piles) and where drilling a borehole is not possible due to unstable (collapsible) soil and when the pile's borehole cannot be sealed against water ingress. Casing sections are bolted together (male/female joints) to form a "string" and are generally turned and forced (driven) into the soil by a drill rig fitted with a hydraulically driven, high torque, rotary drive assembly. Larger drill rigs can produce greater than 460 kNm of torque and 600 kN of pulling/pushing force. The casing's male joints are generally left protruding 0.5 to 1.0 m or more above ground level, allowing additional casing sections to be added while keeping the joint free from soil contaminates. The male/female joints use special conical bolts to join the casing sections (1 m to 6 m long sections), facilitating drilling to depths of 30m or greater. The joints can be fitted with rubber "O" rings and are generally assembled with grease to form a liquid-tight seal which prevents ground water from entering the borehole. The grease also provides for easier joint assembly and separation, and reduces the chance of concrete entering and setting in the joints.

The general drilling procedure using sectional casings will now be described for background purposes. Sectional casings are attached to the drill rig's rotary drive by a mechanical or automatic locking casing drive adapter (CDA). The CDA features locating pins and drive key inserts that align with the casing's top, male joint. The pins retain the casing to the CDA for lifting and pulling the casing from the borehole, while the drive keys are designed to take the rotational torque when drilling. The first sectional casing that enters the soil is fitted with a bolt-on casing shoe, fitted with carbide cutters that are designed to cut in clockwise and counter-clockwise directions. The casing shoe's carbide cutters are either pin-on or weld-on and are equally spaced around the shoe in an alternating offset pattern which produces a kerf (cutters extend beyond the casing and shoe's inner and outer diameter) when cutting, allowing the casing or casing string to cut and penetrate the soil while minimizing sticking and/or binding. The sectional casing/shoe is generally aligned to a fixed reference point(s) on the ground using a tape measure, and checked for vertical alignment using an "I" beam level with vial bubbles or digital readout. Once aligned, the casing/shoe is turned and forced into the soil by the drill rig's rotary drive assembly.

It is the skill and responsibility of the front-end personnel and drill rig's operator to make sure that the casing/shoe does not wander off course and stays in alignment when first starting the casing/shoe into the soil. Sectional casings are generally turned (driven) into the soil until they either run out of length (0.5 to 1 m above ground level), or the drill rig runs out of turning torque, or the penetration rate slows to an unacceptable level. Once the first casing/shoe has been driven into the soil to the required depth, it is then detached from the drill rig's rotary drive assembly. An auger or drill bucket attached to the Kelly bar (also driven by the drill rig's rotary drive assembly) is then used to drill out and remove the soil from inside of the casing. Generally, the auger or drill bucket is not drilled past the end of the casing shoe so as not to loosen the soil around the outer diameter of the casing. After removal of the soil and in some cases water, the drill rig picks up another section of casing and positions it on top of the casing already protruding from the soil. The two sections are joined together to form what is called a "string" by installing special conical retaining bolts (generally installed with an air impact gun). Once the joint is tightened, the casing string is driven further into the soil as described above, additional casing sections are added to the string, and again, soil is removed until the required depth is reached. Casing strings are often drilled down through the soil into underlying rock to form a socket. Core barrels and rock augers are used for the final removal of rock from the inside of the casing string. Once all the soil/rock has been removed, the empty core of the casing string is ready to accept poured concrete. Steel cages and "I" beams are generally placed in the casing string for reinforcement before pouring the concrete.

Once the concrete has been poured, the casing string must be pulled (extracted from the soil) before the concrete sets. The casing string and the drill rig are re-attached to each other (previously disconnected to pour concrete). Upward force (pull) and rotational torque are applied by the drill rig to the casing string, leaving a column of setting and in some cases, reinforced concrete, as the string is pulled from the soil. As the casing string is pulled from the soil, the sections that were added must now be removed and extra concrete added as the concrete's level drops as the casing is being pulled.

Before the conical bolts can be removed from the male/female joints, the casing string must be held (clamped) below each protruding joint, to prevent the casing string from slipping back into the borehole under its own weight. Contractors use various methods of holding the casing string before disconnecting the drill rig's CDA. Most holding methods generally take too much time to setup, can be unsafe, suffer from poor reliability and require extra personnel. One such method is to wrap a wire rope (cable) around the casing string and attach the cable to a piece of construction equipment (wheel loader, track loader, excavator, etc.) and then, by pulling the cable tight, pull the casing to one side of the borehole, thereby jamming it. This method is unsafe as the cable can slip on the casing, cut into the ground, break, be run over by construction equipment or become a tripping hazard for front-end personnel.

Mechanical clamps (generally designed and built by the contractor) are the preferred method of holding the casing string before disconnecting the drill rig's CDA. However, they require physical handling before being tightened around the casing using a large threaded bolt(s). Dirt, rust and concrete contamination can cause the bolt's threads to bind and wear. Hydraulic clamps are generally preferred over the mechanical type, but require a separate hydraulic power pack and hydraulic hoses.

Up to now, mechanical and hydraulic clamps have not been very practical as they generally sit on the ground and become contaminated with soil, mud, water and spilled concrete and generally require the front-end personnel to work in a bent-over position or, on their knees. Hydraulic clamps require hydraulic hoses and quick couplers that are susceptible to damage and can fill with contaminates during assembly and disassembly, leading to eventual hydraulic system wear and/or failure. The clamp's hydraulic cylinder's chrome plated rod, and seal assembly, are a constant problem, due to concrete sticking to the rod and tearing the rod seal assembly. Seal and rod damage cause hydraulic leaks and soil contamination. A hydraulic oil spill can turn into an environmental shutdown of the work site in some jurisdictions.

Accordingly, it would be advantageous to provide a new and improved product, system and method for holding the casing string before disconnecting the drill rig's CDA.

SUMMARY OF THE PRESENT INVENTION

The objects mentioned above, as well as other objects, are solved by the present invention, which overcomes disadvantages of prior products, systems and methods for holding the casing string before disconnecting the drill rig's CDA, while providing new advantages not previously associated with such products, systems and methods. This summary is provided to introduce a selection of concepts in a simplified form that are further described below in the Detailed Description, so that the claimed invention may be better understood. However, this summary is not intended to limit the scope of the claimed subject matter.

It can be seen from the general drilling procedure outlined above, that starting the casing/shoe into the soil and keeping it in the correct location, without it wandering off, is up to the skill of the front-end personnel and the drill rig's operator. It can also be seen that clamping and holding the casing string below the protruding joint during extraction, has until now, been a problem. If a casing string slips back into its borehole under its own weight (joint buried below ground level), especially when it is filled with setting, reinforced concrete, the casing string and the hole are generally considered to be lost (not acceptable), as it may not meet design specifications. It can take days of drilling with special augers and tools to remove the set concrete and the casing string, especially when steel "I" beams or steel cages are used to reinforce the pile.

The present invention (guide/clamp assembly) provides a mechanical guide assembly that accurately positions the first casing/shoe assembly and prevents it from wandering when initially turned and forced into the soil. The present invention also provides a mechanical clamp assembly that is self-aligning and self-tightening while holding (clamping) a casing string during extraction from a drilled borehole, allowing casing sections to be removed while the drill rig is disconnected. Preferably, the guide/clamp assembly is also self-releasing when the casing string is raised by the drill rig. The present invention requires very little physical handling: no hand-tools to tighten, no bolts to undo and no outside hydraulic power to provide clamping force. The guide/clamp assembly provides clamping force when sitting on uneven soil or sinking unevenly into the soil as weight from the casing string transfers to the guide/clamp assembly. It will also function when partially or totally submerged in water or mud. The guide/clamp assembly does not use or require complicated parallelogram linkages (as described in U.S. Pat. No. 7,527,093) that would fill with soil, concrete and water and could also freeze in winter. The gripping arms in the guide/clamp assembly provide limited oscillation in all planes ("x", "y" and "z," limited by mechanical linkage), providing up to 6 degrees of misalignment in all directions, between the guide/clamp assembly and the casing.

The guide/clamp assembly can have a minimum of three gripping arms. For larger diameter casings, the use of four or more gripping arms is possible. No matter how many gripping arms are used, they are preferably equally spaced around the guide/clamp assembly, providing a self-aligning and tightening action against the casing. Also, initial centralizing of the casing in the clamp's mainframe is not required as the gripping arms automatically align and adjust as they tighten against the casing.

As noted above, the guide/clamp assembly can function as a centralizing guide for initial positioning of the first casing/shoe using a self-centering, ground centralizer assembly (detailed below) that is temporally attached, without fasteners, to the guide/clamp assembly. The guide/clamp assembly may be lifted into position (using a loader, drill rig, service crane, etc.) with the ground centralizer assembly, and then aligned to a marked ground reference point using the ground centralizer's built-in plumb bob or laser. Once aligned, the ground centralizer assembly can be removed, and the guide/clamp assemblies' legs can be pinned to the soil using locating pins (stored in the guide/clamp assemblies' frame). The locating pins are designed to be driven into the soil by use of a sledge hammer and pulled out of the soil by the drill rig's service winch. Optional legs can be installed with spikes or cleats rather than using locating pins if soil conditions permit. Bolt-on pads with cleats or spikes can also be attached to the leg's base plates. It is also possible (not recommended as the front-end personnel have to work in a bent-over position) to remove the legs and allow the guide/clamp assembly to sit directly on the soil using its built-in cleats, which are part of the main frame assembly. The guide/clamp assemblies' spikes/cleats can be forced into the soil (once alignment has been completed) by using the casing/shoe attached to the drill rig. The casing/shoe is lowered into the guide/clamp's main frame assembly (casing shoe not in contact with the soil) with the gripping arms in the open position as shown later in FIG. 9. The gripping arms are then manually closed against the casing/shoe and the casing/shoe is forced down by the drill rig, thereby forcing the guide/clamp assemblies' spikes/cleats into the soil. The casing/shoe is then raised by the drill rig, which allows the gripping arms to automatically release from the casing/shoe. Once released, the gripping arms can then be manually opened, allowing the casing/shoe to be removed and swung away from the casing guide/clamp assembly by the drill rig. The self-centering, ground centralizer assembly is again attached to the guide/clamp assembly as a final check for positioning.

Once the guide/clamp assembly is finally positioned and locked into the soil, the casing/shoe can then be swung back into alignment and lowered into the guide/clamp assembly until it is positioned just above ground level. Casing/shoe alignment to the guide/clamp assembly is done by placing spacer plates (stored in slots, in the mainframe) in the appropriate, equally-spaced slots in the guide/clamp assemblies' mainframe, while the gripping arms are in the open position. The spacer plates are designed to fit in close proximity with the outside diameter of the casing and accurately centralize the casing/shoe to the guide/clamp assembly while the casing/shoe is still above ground level. With the spacer plates in position, the casing/shoe is then lowered and slowly turned and forced into the soil until a good bite is established. The spacer plates can then be removed and stored in the guide/clamp assemblies' mainframe. The guide/clamp assembly can be left in position during drilling or removed when the next section of casing is to be added.

In a preferred embodiment, an apparatus for use in positioning, guiding and clamping (either for initial positioning and/or removal) a tubular casing used to produce a borehole. The apparatus includes a mainframe encircling the casing and having an opening for receiving the tubular casing. The mainframe carries a guide and clamp assembly, and includes slots equally spaced around the opening, and configured to receive spacer plates for use in centralizing the tubular casing within the opening. The guide and clamp assembly preferably includes a plurality of gripping arms for use in gripping the casing, and providing limited oscillation in all planes to counteract misalignment between the mainframe and the casing.

In an alternative embodiment, the gripping arms may be pivotable about pivot pins, and the guide and clamp assembly may include stop plates supporting the gripping arms, which reduce stresses on the pivot pins when the casing undergoes axial loads. The mainframe may also be provided with lifting lugs equally spaced around the mainframe, and wear pads equally spaced around inside portions of the mainframe adjacent the opening.

In an alternative embodiment, each spacer plate may include a handle, a notch and a curved front face that can be fitted into a corresponding guide slot in the mainframe, allowing the spacer plates to be used to centralize a misaligned casing within the opening relative to the mainframe.

In an alternative embodiment, the mainframe may include removeable legs and cleats, with the cleats enabling the mainframe to sit directly on soil when the legs are removed. Alternatively, or additionally, the mainframe may include legs with a flat pad with holes for pinning or bolting cleats or spiked pads, or accepting retaining pins, that are driven into soil.

The gripping arms may be equally spaced around the opening and able to independently rotate in the "x", "y" and "z" axes. Preferably, the gripping arms are able to frictionally grip a portion of an aligned or misaligned casing, and automatically release the grip when the casing is to be raised. Preferably, too, the gripping arms can be manually opened, allowing spacer plates to be located within mainframe slots. It is also preferred that the gripping arms are positioned in-line with support legs. Stop plates may be used to limit a closed position of the gripping arms. Preferably, the gripping arms automatically increase their grip on a casing as the vertical load on the casing is increased.

In an alternative embodiment, gripping arm assemblies, corresponding to each gripping arm, may be used, with each assembly being pivotally attached to the mainframe by a removable pin and pivoting around the "x" axis. Each gripping arm assembly may include a spherical bearing and three links working and pivoting together in the "x, "y" and "z" axes. Alternatively, each gripping arm assembly may include a spherical bearing and two links working and pivoting together in the "x" axis, or a spherical bearing and two links working and pivoting together in the "y" and "z" axes. In yet another alternative embodiment, each gripping arm assembly may include first and a second gripping arm links with mechanical stops, limiting "x" axis rotation, or a third gripping arm link with mechanical stops, limiting "y" and "z" axis rotation. Alternatively, the third gripping arm link may include replaceable spherical bearings and spacer with stops to prevent "x" axis rotation. In yet another embodiment, the third gripping arm link may include elastomeric elements used to resist "z" axis rotation and to protect the spherical bearing from contamination and aid grease retention. Replaceable gripping dies may also be used.

In another embodiment, a ground centralizing assembly may be used that is self-centralizing and can be aligned to a fixed ground reference point using a plumb bob or self aligning laser.

A method for the positioning, guiding and then clamping of a tubular casing (whether for initial positioning and/or casing removal) used to produce a borehole, also forms a part of the invention. A mainframe with an opening may be positioned for receiving the tubular casing, so that the mainframe surrounds the casing. The mainframe carries, either by attachment or integrally, a guide and clamp assembly with: (a) slots equally spaced around the opening and configured to receive spacer plates for use in centralizing the tubular casing within the opening; and (b) a plurality of gripping arms for selectively clamping onto the casing, the gripping arms providing limited oscillation in all planes to counteract misalignment between the mainframe and the casing. After casings are attached together to form a casing string, and the casing string is driven into soil and cement is poured into the casing string, sections of the casing string may be serially extracted from the soil by first clamping the guide and clamp assembly of the mainframe onto the casing string at a position below a joint of the casing string to prevent the casing string from slipping back into the borehole under its own weight, then removing a portion of the casing string above the joint, and then repeating this extraction process for further sections of the casing string. The casing may be centralized/centered within the mainframe by aligning the casing to a fixed ground reference point using a plumb bob or self aligning laser.

Definition of Claim Terms

The terms used in the claims of the patent are intended to have their broadest meaning consistent with the requirements of law. Where alternative meanings are possible, the broadest meaning is intended. All words used in the claims are intended to be used in the normal, customary usage of grammar and the English language.

"Casing" means tubular sections for use in forming concrete piles, secant walls or the like, for facilitating the drilling of a borehole, particularly in the presence of unstable (collapsible) soil or when the pile's borehole cannot be sealed against water ingress.

"String" refers to multiple casing sections, which may be bolted together (male/female joints), and which are generally turned and forced (driven) into the soil by a drill rig fitted with a hydraulically driven, high torque, rotary drive assembly.

BRIEF DESCRIPTION OF THE DRAWINGS

The novel features which are characteristic of the invention are set forth in the appended Claims. The invention itself however, together with further objects and attendant advantages thereof, can be better understood by reference to the following description taken in connection with the accompanying drawings, in which:

FIG. 6*a* shows the theoretical position that all three gripping arms would assume in the lowered position against a casing with no wear on any component or casing, no weight transfer from the casing and if the casing and guide/clamp assemblies' mainframe 1 were in perfect alignment. FIG. 6*b* is similar, but with weight being transferred from the casing string as it tries to slip back into the borehole.

FIG. 7*a* shows link 12 rotated 4 degrees to the right "Y" axis) to the centerline of link 11 (no rotation (tilt) in the "Z" axis as shown in FIGS. 8*a* and 8*b*). FIG. 7*b* shows link 12 rotated 4 degrees to the left ("Y" axis) to the centerline of link 11 (no rotation (tilt) in the "Z" axis as shown in FIGS. 8*a* and 8*b*).

FIG. 8*a* shows the end view of link 12 rotated down 3 degrees to the left "Z" axis) to the centerline of link 11 with the left stop 1 in contact with mainframe 1. FIG. 8*b* shows the end view of link. 12 rotated down 3 degree s to the right ("Z" axis) to the centerline of link 11 with the right stop 21 in contact with mainframe FIG. 8*c* shows a side view of link 12 rotated down 3 degrees to the right ("Z" axis) to the centerline of link 11 (as shown in FIG. 8*b*) with the right stop 21 in contact with mainframe Limiting stops 20*a* (four stops, two at the top and two at the bottom straddling spherical bearing/spacer 24) prevent link 12 from rotating in the "X" axis in relationship to the centerline of link 11, thereby keeping link 12's front face and die plates 22, 90 degrees to the centerline of link 11.

FIGS. 10*a* and 10*b* are top and sectional (along reference line A-A in FIG. 10*a*) views, respectively, of a three-arm embodiment of the guide/clamp assembly shown with a section casing with male/female jointed ends. Shown are three gripping arms in the open position and two spacer plates 26 (one spacer plate has been removed to show the positioning slot in the present invention's mainframe 1) in position and centralizing the tubular sectional casing 4. The perspective view FIG. 10*c* shows a spacer plate assembly with its body 27 and handle 28. FIG. 10*d* is an exploded view of a section (circled) B in FIG. 10*a*.

(FIG. 14*b* is a topside view and FIGS. 14*a* and 14*c* are underside views, with FIGS. 14*b* and 14*c* showing an attached plumb bob assembly) of the ground centralizer assembly.

DETAILED DESCRIPTION OF PREFERRED EMBODIMENTS OF THE PRESENT INVENTION

The present invention (guide/clamp assembly) provides a mechanical guide assembly that accurately positions the first casing/shoe assembly and prevents it from wandering when initially turned and forced into the soil. The present invention also provides a mechanical clamp assembly that is self-aligning and self-tightening when supporting a casing/casing string and self-releasing when the casing/casing string is raised by the drill rig. It requires very little physical handling, no hand-tools to tighten or undo bolts, or outside hydraulic power to provide clamping force. The guide/clamp assembly provides clamping force when sitting on uneven soil or sinking unevenly into the soil as weight from the tubular casing/casing string is transferred to the guide/clamp assembly. The guide/clamp assembly facilitates the quick and safe removal of casing section from the casing string, even in severe weather and ground conditions and also when partially or totally submerged in water or mud.

The guide/clamp assembly can also function as a centralizing guide for initial positioning of the first casing/shoe section by pinning the frame's legs to the ground or using optional legs fitted with spikes or cleats or spikes or cleats can be attached to the standard legs. The legs can also be completely removed, allowing the guide/clamp assembly to sit directly on the soil with its built-in cleats, which are part of the main frame assembly. The casing/shoe is preferably centralized in the round opening of the guide/clamp assemblies' mainframe by placing spacer plates (stored in the slots in the mainframe) in the equally spaced slots in the mainframe, while the gripping arms are in the open position. The spacer plates are designed to be in close proximity with the outside diameter of the casing's tube. Once the casing shoe has penetrated the soil, the guide/clamp assembly is no longer required to act as a guide, as the casing/shoe normally remains on course, as it is turned and forced (driven) into the soil. The spacer plates can then be removed and stored in the guide/clamp assemblies' mainframe. Replaceable wear pads on the guide/clamp assemblies' mainframe prevent wear to the mainframe when turning and pushing the casing into the soil when the guide/clamp assembly is left inplace. If the guide/clamp assembly has not been used for initial placement and alignment of the casing/shoe, it can be lifted into place, after the casing string has reached the required depth, and the concrete has been poured. Placing the guide/clamp assembly after drilling out the casing string's core and pouring concrete reduces the amount of cleanup and maintenance downtime of the guide/clamp assembly due to soil and concrete spillage.

The three gripping arm embodiment, together with a sectional casing with attached shoe (casing/shoe) fitted with carbide cutters, will primarily be used in the following detailed description.

Figure 1:
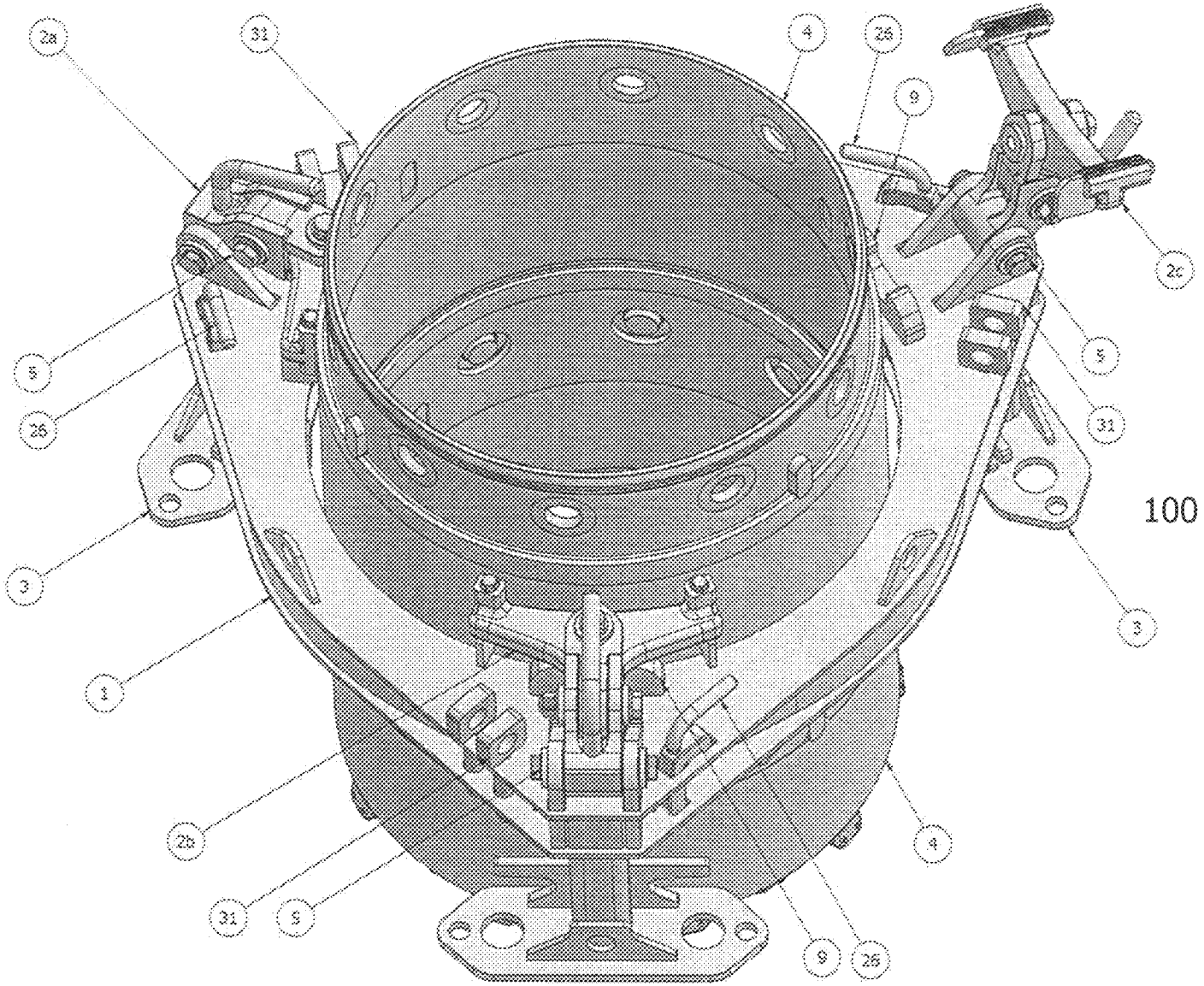
FIG. 1 is a perspective view of a three-arm embodiment of the guide/clamp assembly shown with a 1000 mm diameter section casing 4 with male/female jointed ends and casing shoe with carbide cutting teeth. Shown are two gripping arms in the closed position and in contact with the tubular casing. Also shown is the third gripping arm in the open position, before being positioned against the tubular casing.
Figure 2B:
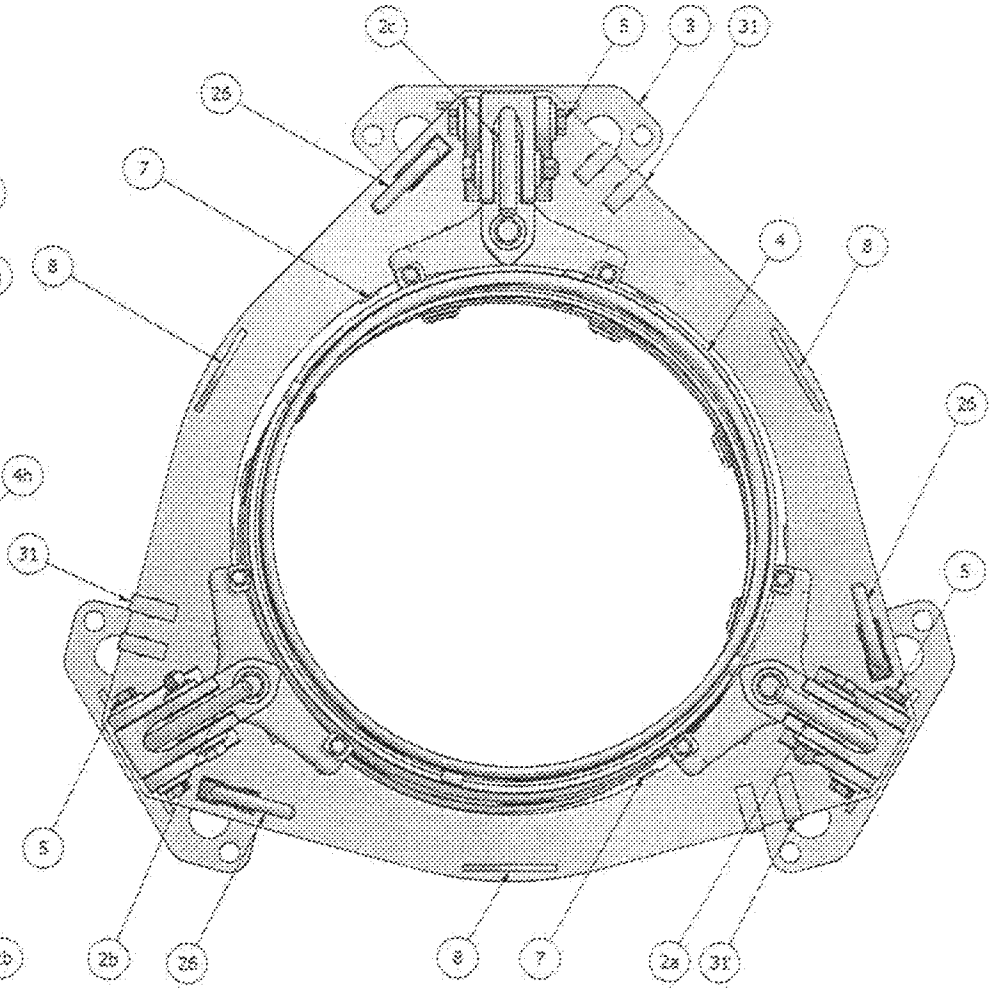
FIGS. 2*a* and 2*h* are side and top views, respectively, of a three-arm embodiment of the guide/clamp assembly, shown misaligned with a sectional casing, such as standing or sinking into uneven or unstable footing.
Figure 2A:
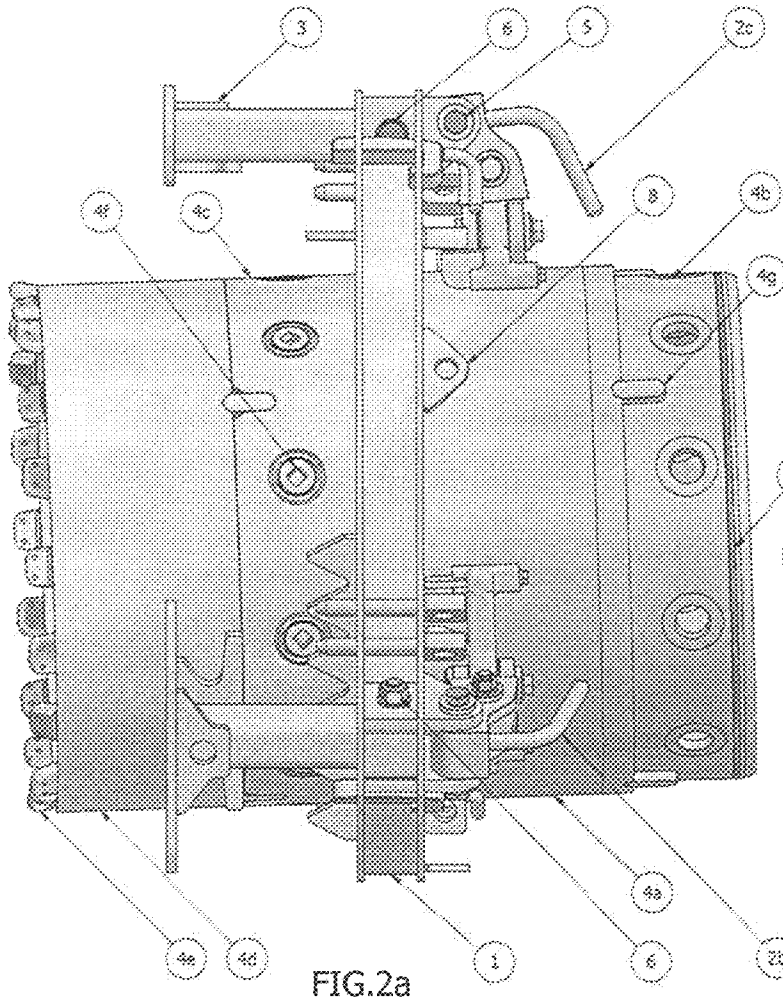

Referring first to FIG. 1, a perspective view of a three-arm embodiment of a guide/clamp assembly, generally referenced as 100, is shown with a reusable, section casing 4. Shown are two gripping arms 2*a*, 2*b* in contact with casing/shoe 4; one gripping arm 2*c* (top right) is shown in the open position (retracted and not yet been positioned against the casing/shoe). The three gripping arms 2*a*, 2*b* and 2*c* are attached to the clamp's mainframe 1 and pivot on pins 5. Referring to FIG. 2, three legs 3 are attached to the mainframe 1 by bolts 6. Pins, rather than bolts, could secure the legs to the mainframe 1. Each leg is preferably in vertical alignment with each gripping arm to reduce stresses in the mainframe. The mainframe's 1 cross-section is preferably reduced between the gripping arms, allowing the guide/clamp assembly to operate against obstructions, such as building walls. The leg's design length determines how far the mainframe and gripping arms sit above ground level. Setting the casing's joint at the correct height above ground level is important as it reduces the time required to connect/disconnect casing sections, prevents dirt contamination of the casing's joints and screws, and allows front-end personnel to work at a comfortable height. The guide/clamp assembly can also operate with the legs removed and can sit directly on the ground. Air impact guns are preferred over hand tools when assembling and disassembling the casing joint's threaded casing screws, as time is of the essence when unbolting casing sections that are full of setting concrete.

FIG. 2 shows top and side views of a three-arm embodiment of the guide/clamp assembly shown in misalignment with the first section, casing/shoe. The guide/clamp assembly would generally be supporting a string of joined, casing sections as they are extracted from the borehole and not just the first section, casing/shoe as shown. Misalignment is generally caused by the casing guide/clamp assembly standing on uneven or sinking into unstable soil. The first section, casing/shoe assembly consists of: a single or double wall tubing 4*a*, male joint 4*b*, female joint 4*c*, casing shoe 4*d*, offset carbide cutting teeth (weld-on type shown) 4*e*, special casing screws 4*f*, drive keys 4*g* and rubber "O" ring 4*h*. Additional casing sections are added and bolted together (female-to-male joint) to form a string and include: a single or double wall tubing 4*a*, male joint 4*b*, female joint 4*c*, special casing screws 4*f*, drive keys 4*g* and optional rubber "O" ring 4*h*. The three gripping arms 2*a*, 2*b* and 2*c* are shown in 100% contact with the casing/shoe due to their ability to pivot independently in the "x", "y" and "z" axes. This is particularly important as weight transfers from a long, heavy casing string to the guide/clamp assembly during extraction from the drilled borehole as unstable ground conditions may cause the legs to sink at uneven rates. A series of replaceable wear pads 7 are equally spaced around the inside of the mainframe 1 and act as an initial centralizing guide for casing 4. Wear pads 7 also prevent wear to the mainframe's weldment if the drill rig is turning the casing with the gripping arms retracted. Lifting cables, slings or chains (not shown) can be attached to lifting plates 8, allowing the guide/clamp assembly to balance and be safely lifted.

Figure 3:
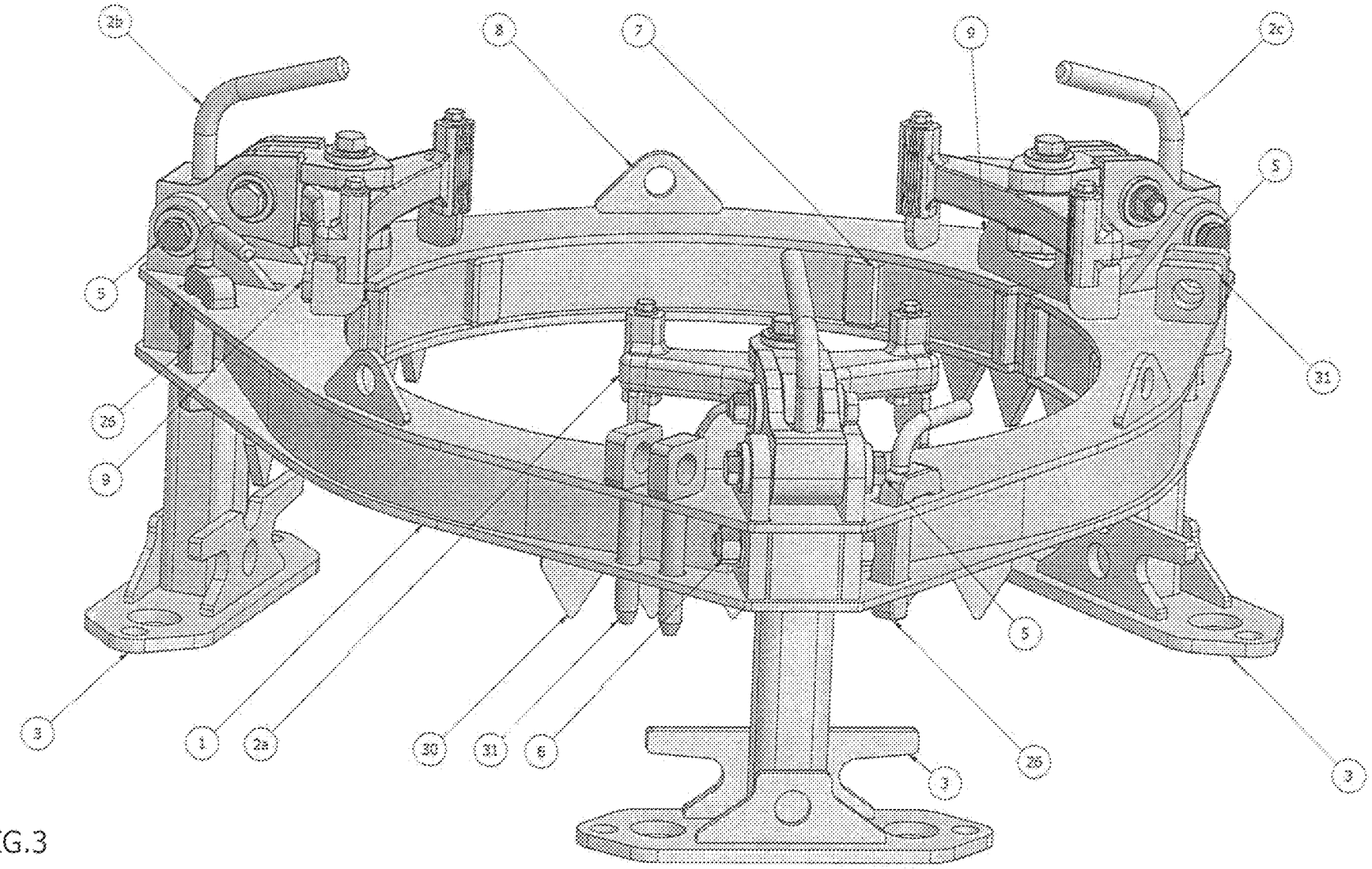
FIG. 3 is a perspective view of a three-arm embodiment of the guide/clamp assembly shown with three gripping arms, spacer plates, mainframe, and legs.

FIG. 3 is a perspective view of a three-arm embodiment of the guide/clamp assembly showing the three gripping arms 2*a*, 2*b* and 2*c* in the fully lowered position and resting in the torque/stop plates 9 (one per gripping arm). Torque/stop plates 9 reduce the stress on pivot pins 5 if the drill rig's operator accidentally tries to turn and push the casing string into the soil with the gripping arms fully engaged with casing 4. The torque/stop plates 9 also limit the closed position of the gripping arms when not in contact with the casing.

Figures 4A, 4B, 4C, 4D:
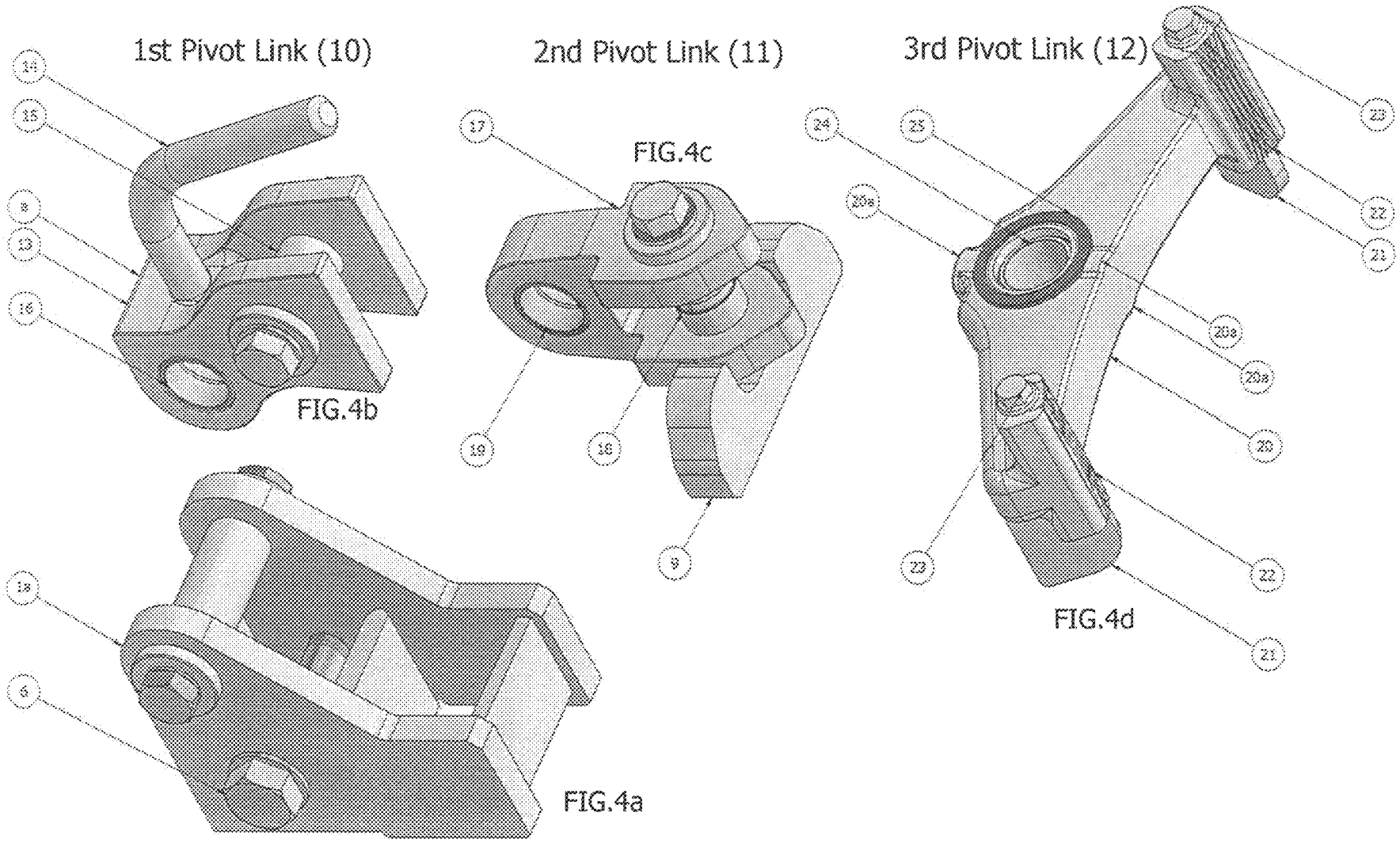
FIGS. 4*a*, 4*b*, 4*c* and 4*d* are exploded views of a single gripping arm embodiment of the guide/clamp assembly showing stationary pivot box 1*a* welded to the mainframe 1 and accepting support legs 3 (FIG. 4*a*), and first (FIG. 4*h*), second (FIG. 4*c*) and third (FIG. 4*d*) pivot links 10, 11 and 12, respectively, of the mainframe, to which the gripping arm attaches and pivots.

FIG. 4 is an exploded view of a single gripping arm embodiment of the guide/clamp assembly showing the various links, pins and part of the mainframe 1 to which the gripping arm attaches and pivots. The first pivot link 10 (consisting of link body 13, handle 14, pivot pin 15 and pivot bushing 16) is attached to the mainframe 1 by pivot pin 5 and pivots on replaceable pivot bushing 16. Handle 14 (operated by the front-end personnel) manually raises and lowers the gripping arm embodiment in a single pivoting action ("x" axis). The gripping arm's maximum open position is limited by link body 13 (location a) encountering the top plate of mainframe 1. The second pivot link 11 (consisting of link body 17, pivot pin 18 and pivot bushing 19) is attached to the first pivot link 10 by pivot pin 15 and pivots around bushing 19. The pivoting action is in a single axis "x" (same as first pivot link 10) and is preferably limited to approximately 8 degrees. Closing (lowering) allows the gripping arm embodiment to either contact torque/stop plate 9, or the outer diameter of the casing. If the casing is perfectly centralized and aligned in the guide/clamp assembly, all the gripping arms would make contact with only the casing, and torque/stop plates 9 would never be contacted. The guide/clamp assembly can provide 100% clamping action when offset and/or misaligned to the casing, which is generally the case. Gross misalignment could cause one (3gripping arm embodiment) or two (four gripping arm embodiment) of the gripping arms to contact the torque/stop plates 9 and the casing at the same time, while the remaining gripping arms would only be in contact with the casing (again 100% clamping action is available).

Figure 5B:
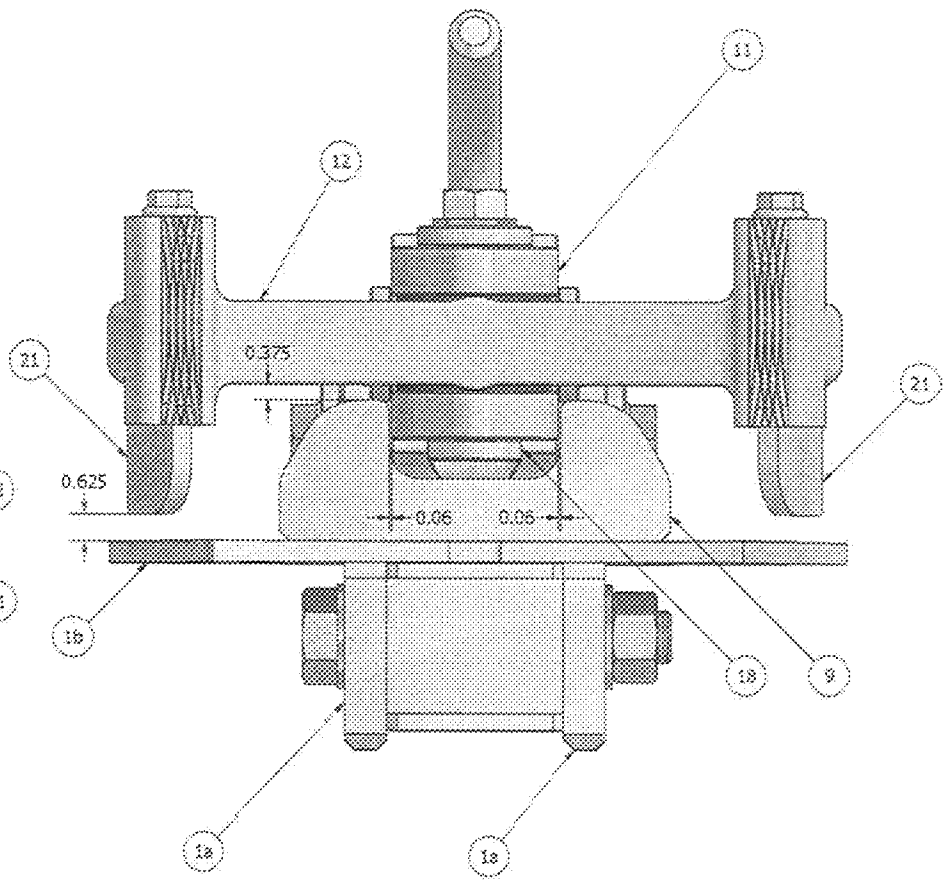
FIGS. 5*a* and 5*b* are side and end views, respectively, of pivot links 10, 11 and 12 of the present embodiment showing one gripping arm assembled and all links at zero-degree tilt (neutral position) in the "x","y" and "z" axes.
Figure 5A:
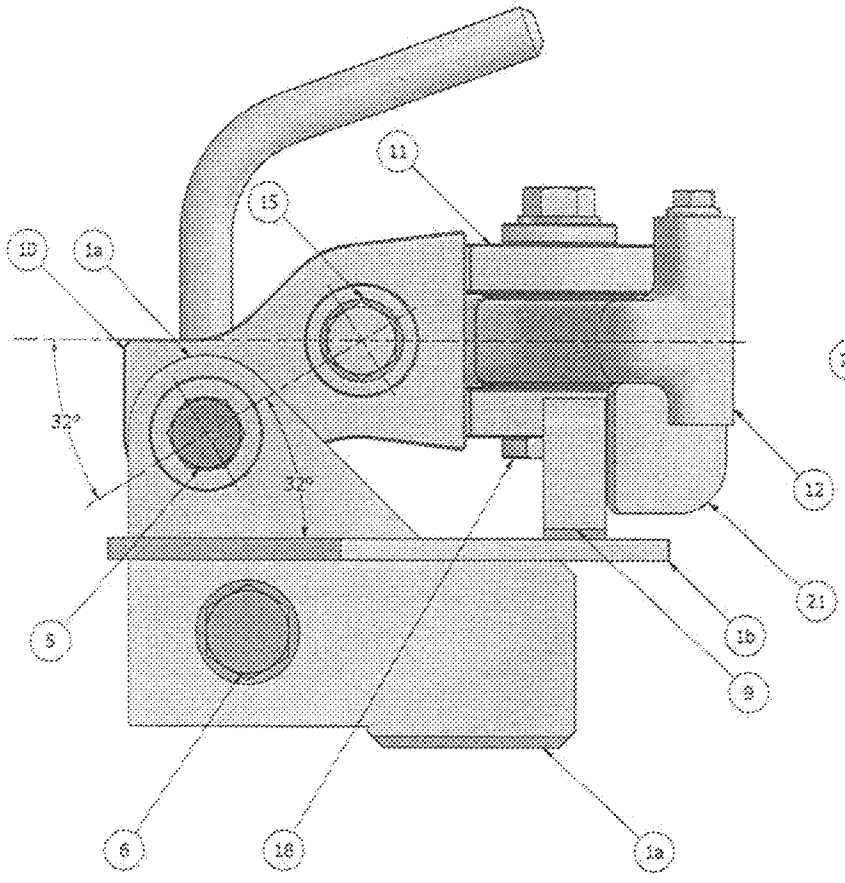

Referring to FIGS. 4-6, the third pivot link 12 (consisting of link body 20, stop plates 21, replaceable die plates 22, die plate retainer bolts 23, spherical bearing/spacer 24 and two elastomeric centering washers 25) is attached to the second pivot link 11 by pivot pin 18 and spherical bearing/spacer 24. The pivoting action is in two axes ("y" and "z") and preferably limited to approximately 8 and 6 degrees. Spherical bearing/spacer 24 could provide a pivoting action in all three axes; however, limiting stops (ramps) 20*a* are cast into the top and bottom of link body 20 to prevent the "x" axis from functioning. Elastomeric centering washers 25 are an interference fit between link body 20 and the body of the second pivot link 11 (body 17) and retained by the bearing/spacer 24. The elastomeric washers help keep dirt out of the spherical bearing/spacer and keep link body 20 at approximately zero degrees ("z" axis) of tilt in relation to link body 17 when not in contact with a casing. Attached to the outer ends of link body 20 are stop plates 21. Stop plates 21 limit the amount of "z" axis tilt while the gripping arms are under load (generally holding a casing string and in contact with torque/stop plate 9) by contacting the mainframe's top plate 1. Stop plates 21 also retain die plates 22 and assist with the "x" axis alignment when in contact with a casing. Die plates 22 are manufactured from hardened steel and contact the outer diameter of a casing. Die plates 22 are replaceable and have a raised diamond pattern with sharp edges that bite into the casing's outer diameter and provide a positive grip. Die plates 22 are replaced, when worn, by removing die plate retainer bolts 23.

FIG. 5 shows side and end views of links 10, 11 and 12 of the present embodiment with one gripping arm assembled and all links at zero-degree tilt (neutral position) in the "x", "y" and "z" axes. Link 10 pivots on pin 5, located in two vertical plates 1*a*, which are part of the guide/clamp assemblies' mainframe 1 (FIG. 1). The gripping arm's second pivot link 11 is constrained by torque/stop plate 9 when in the lowered position, as shown. A total side clearance of approximately ⅛" prevents binding due to dirt and concrete contamination between torque/stop plate 9 and second pivot link 11. As shown, the gripping arm has ⅜" more travel before link 12 contacts torque/stop plate 9 as it rotates around pin 5. Link 12 and stop plates 21 have ⅝" clearance in the neutral position between the mainframe's top plate 1*b*. Stop plates 21 only limit the tilt angle ("z" axis) of link 12 as shown below with reference to FIG. 8. Torque/stop plates 9 not only limit the travel of the gripping arms, but also reduce the stress on pivot pins 5 if the drill rig's operator accidentally tries to turn and push the casing into the ground with the gripping arms fully engaged with a casing. Preferably the angular references with links 10 and 11 in their neutral positions are about 32 degrees as measured from the mainframe's top plate 1*b*.

Figure 6B:
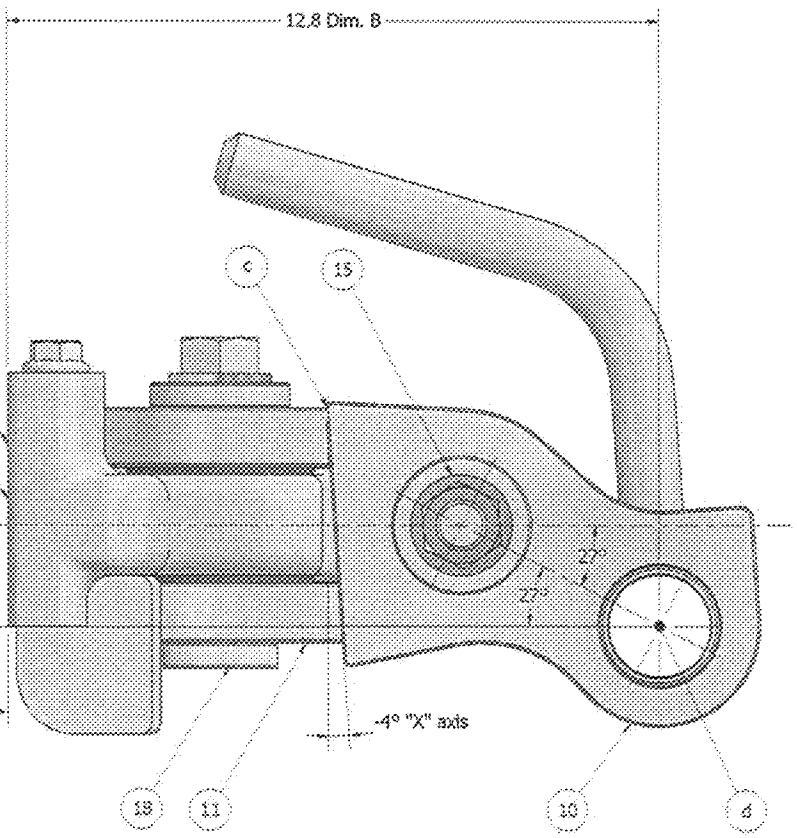
FIGS. 6*a* and 6*b* are side views of links 10, 11 and 12 of the present embodiment showing the position of a single gripper arm with links 10 and 11 at maximum stop angle in both directions while link 12 gripping die plates 21 remain at 90 degrees to the present invention's mainframe 1 top plate.
Figure 6A:
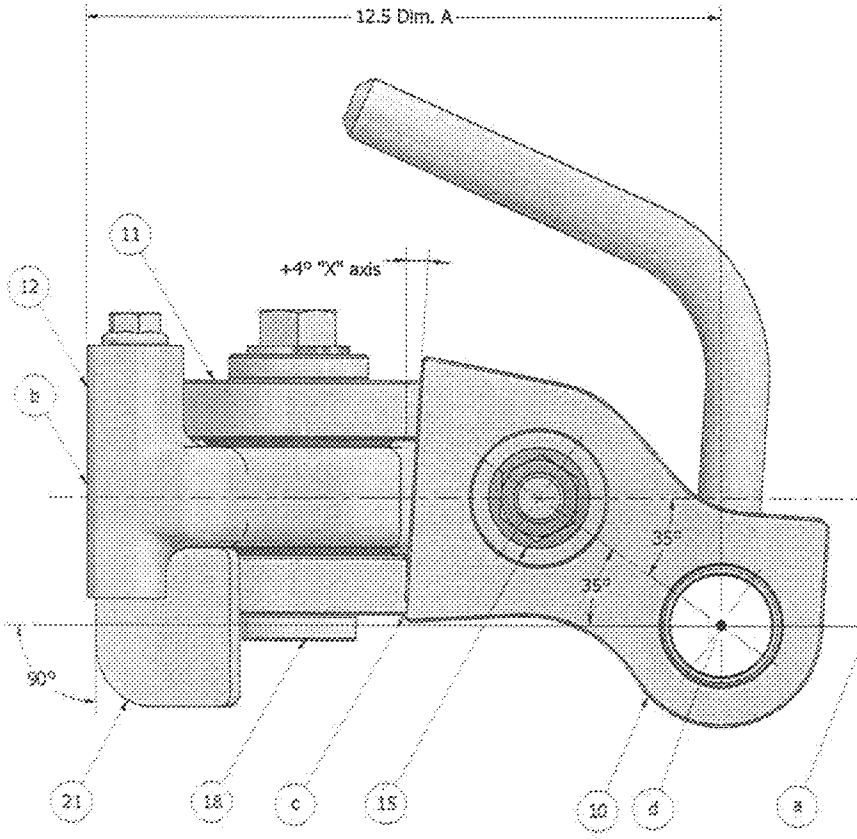

FIGS. 6*a* and 6*b* are side views of links 10, 11 and 12 of the present embodiment showing the position of a single gripper arm assembly with links 10 and 11 at maximum stop angle in both directions, while link 12 and stop plates 21 remain at 90 degrees to the guide/clamp assemblies' mainframe 1 top plate. FIG. 6*a* shows the theoretical position that all three gripping arms would assume in the lowered position against a casing with no wear on any component or casing, no weight transfer from the casing and if the casing and guide/clamp assemblies' mainframe 1 were in perfect alignment, i.e. casing vertical, centralized and at 90 degrees to mainframe's 1 top plate, if measured at any point around the mainframe's top plate and casing's outer diameter. Reference line a is parallel to the top plate of mainframe 1 (FIG. 1). Reference b is the contact point of link 12 (contacted by die plates 22 (FIG. 4), two per gripping arm) to the vertical casing. Point c is the contact reference between links 10 and 11 and point d is the pivot point for link 10. FIG. 6*a* shows links 10 and 11 in contact with each other at reference point c (+4 Deg. "X" axis and at a reference angle of 35 degrees, measured between link 10, pivot point d, pin 15 and reference plane a). The Dim. A distance is 12.5" from link 10 pivot d to the die plates 22 (ref. b) at no load.

FIG. 6*b* shows the theoretical position that the gripping arms would assume, in the lowered position, with weight being transferred from the casing string (present embodiment sitting on stable ground) as it tries to slip back into the borehole. Link 10 has pivoted around pivot point d and link 11 has rotated around pivot pin 15 to contact each other at reference c (−4 Deg. X axis and at a reference angle of 27 degrees, measured between link 10 pivot point d, pin 15 and reference plane a). In the preferred embodiment, the distance from link 10 pivot point d to the die plates 22 (ref. b) is now 12.8". In actual operation, the gripping arms are forced down by only 1 or 2 degrees, as the casing cannot be crushed, and the guide/clamp assemblies' mainframe cannot expand (pivot points d are fixed points on mainframe 1). The extra degrees of movement from 35 to 27 degrees is to compensate for casing wear (outside diameter reducing) and die plate 22 (raised pattern worn) wear. Weight transfer from the casing string to the gripping arms has forced the gripping arms down, thereby forcing die plates 22 to grip the casing at equally spaced locations around the casing. The greater the weight transfer, the greater the gripping force, as the reference angle reduces from 35 towards 27 degrees. The gripping arms are equally spaced around the casing to reduce casing crush, especially if thin wall, double wall casings are being used. The double link embodiment, including pivot pin 15 and links 10 and 11 allows link 12 and its die plates 22 to always contact the outer diameter of the casing even when the casing is not centralized and not at 90 degrees to mainframe 1's top plate.

Figure 7B:
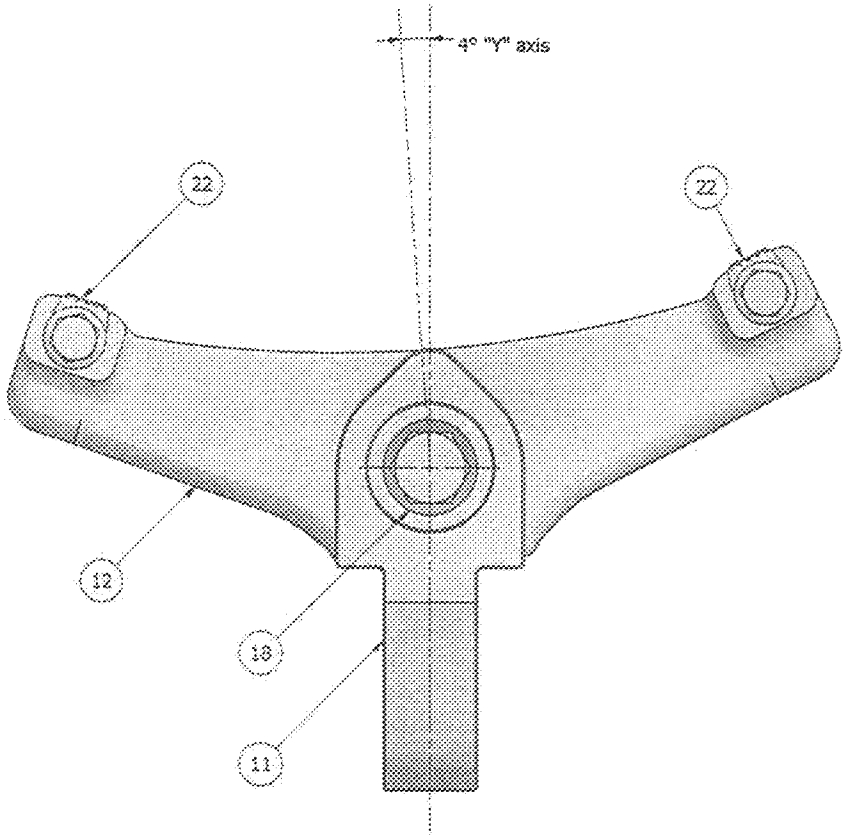
FIGS. 7*a* and 7*b* are top views of links 11 and 12 of the present embodiment showing the maximum angular rotation ("Y" axis) in a single plane around pivot pin assembly 18.
Figure 7A:
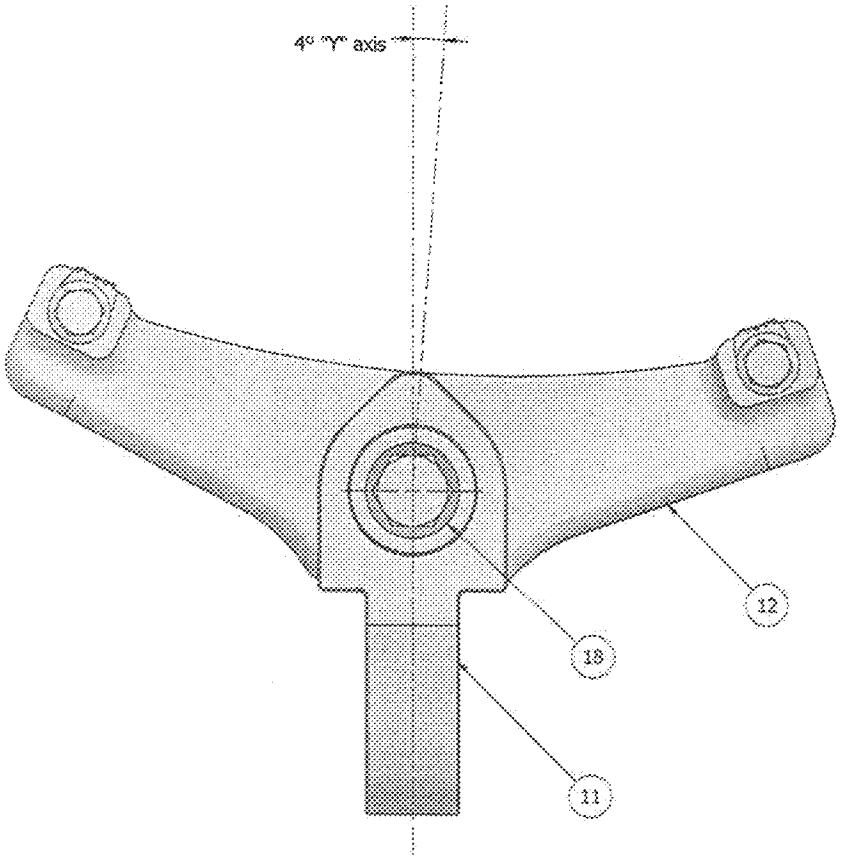

FIGS. 7*a* and 7*b* are top views links 11 and 12 of the present embodiment showing the maximum angular rotation (8 degrees, "Y" axis) in a single plane around pivot pin assembly 18. Die plates 22 grip the outside diameter of the casing. "Y" axis rotation is required to maintain equal force on die plates 22 if the guide/clamp assembly is not centralized, aligned or sinking into the ground as weight transfers from the casing string. "Y" axis rotation also maintains equal force on die plates 22 if the casing is not perfectly round or has become dented.

Figures 8A, 8B, 8C:
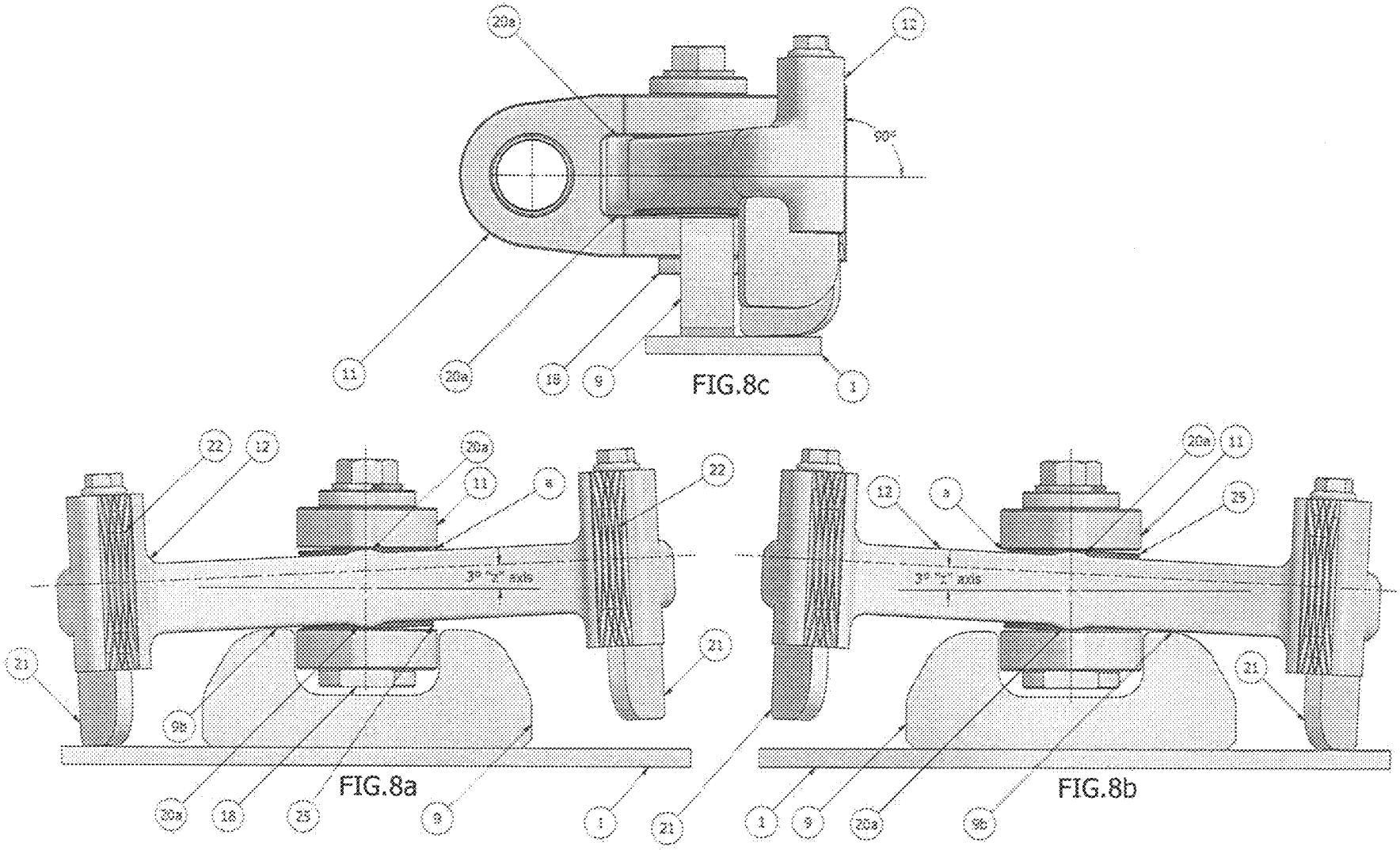
FIGS. 8*a*-8*c* are end, end and side views, respectively, of links 11 and 12 of the present embodiment showing the maximum angular tilt ("Z" axis) of link 12 in a single plane around pivot pin assembly 18 and spherical bearing 24 shown in FIG. 4.

FIGS. 8*a*, 8*b* and 8*c* are side and end views of links 11 and 12 of the present embodiment showing the maximum angular tilt ("Z" axis) of link 12 in a single plane around pivot pin assembly 18 and spherical bearing/spacer 24 (FIG. 4). The third pivot link 12 is attached to the second pivot link 11, by pivot pin 18 and spherical bearing/spacer 24. The pivoting action is in two axes ("y" and "z") and limited to approximately 8 and 6 degrees. Spherical bearing/spacer 24 could provide a pivoting action in all three axes. However, limiting stops (ramps) 20*a* are cast into the top and bottom of link body 20 (part of link 12) to prevent the "x" axis from functioning. Two elastomeric washers 25 are located between the top and bottom of link body 20 and the body of the second pivot link 11. The elastomeric washers are an interference fit and help keep contaminates out of the spherical bearing/spacer and keep link body 20 at approximately zero degrees ("z" axis) of tilt in relation to pivot link 11 when not in contact with a casing. Attached to the outer ends of link body 20 are stop plates 21. Stop plates 21 limit the amount of "z" axis tilt (3 degrees in each direction) if they contact the mainframe's 1 top plate when the gripping arm/s are under load and in contact with torque/stop plates 9, while holding a casing string. If the gripping arm/s are not in contact with torque/stop plates 9, the amount of "z" axis tilt is limited (3 degrees in each direction) by pivot link 12 contacting the outer edges of pivot link 11 at point a. Torque/stop plates 9 have a rounded profile at 9*b* allowing pivot link 12 to roll, as it tilts.

Figures 9A, 9B, 9C:
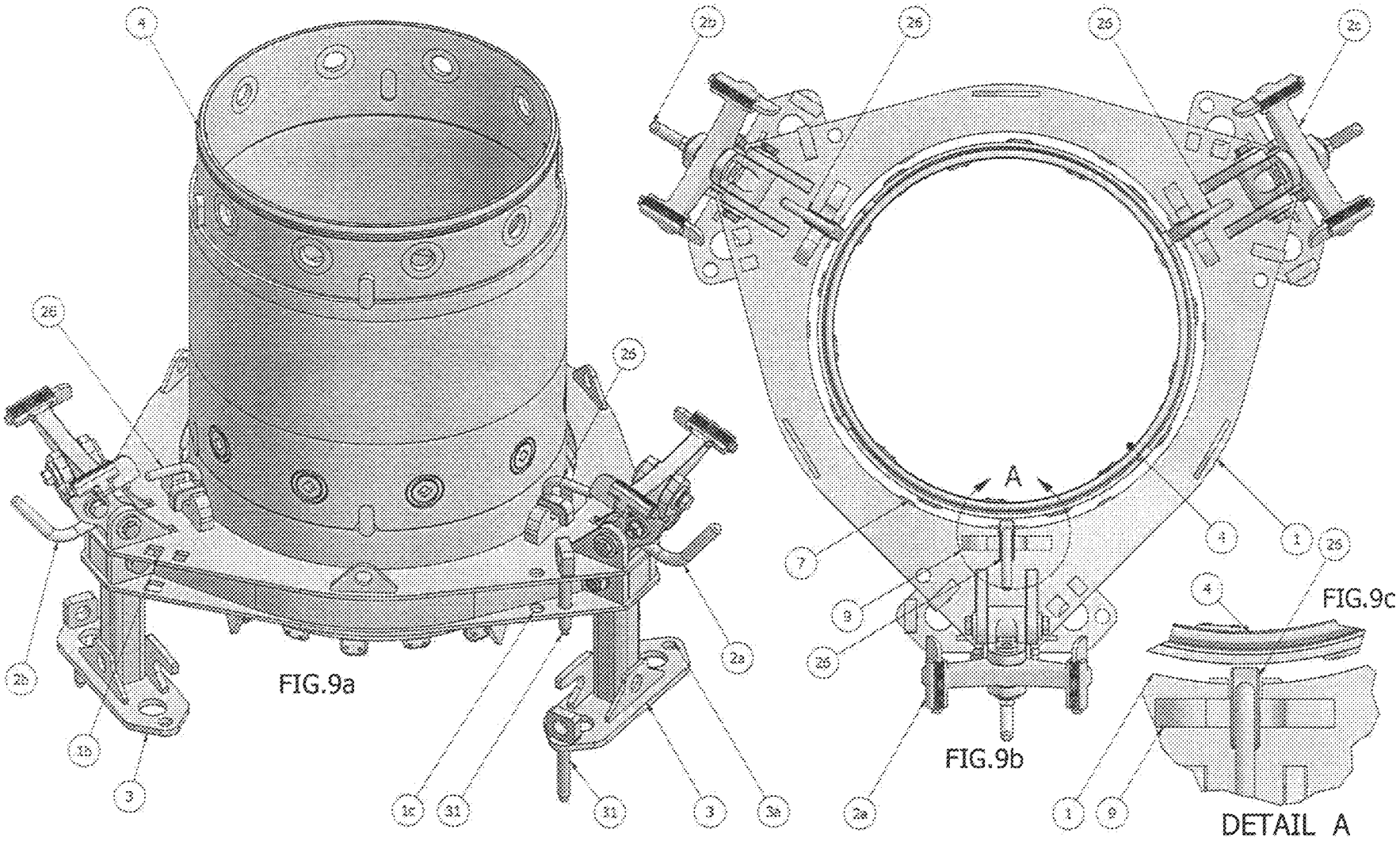
FIGS. 9*a*, 9*b* and 9*c* are perspective, top and exploded/detail views, respectively, of a three-arm embodiment the guide/clamp assembly shown with a section casing with male/female jointed ends. Shown are three gripping arms in the open position and three spacer plates 26 in position and centralizing the tubular sectional casing 4.
Figures 11A, 11B, 11C, 11D, 11E:
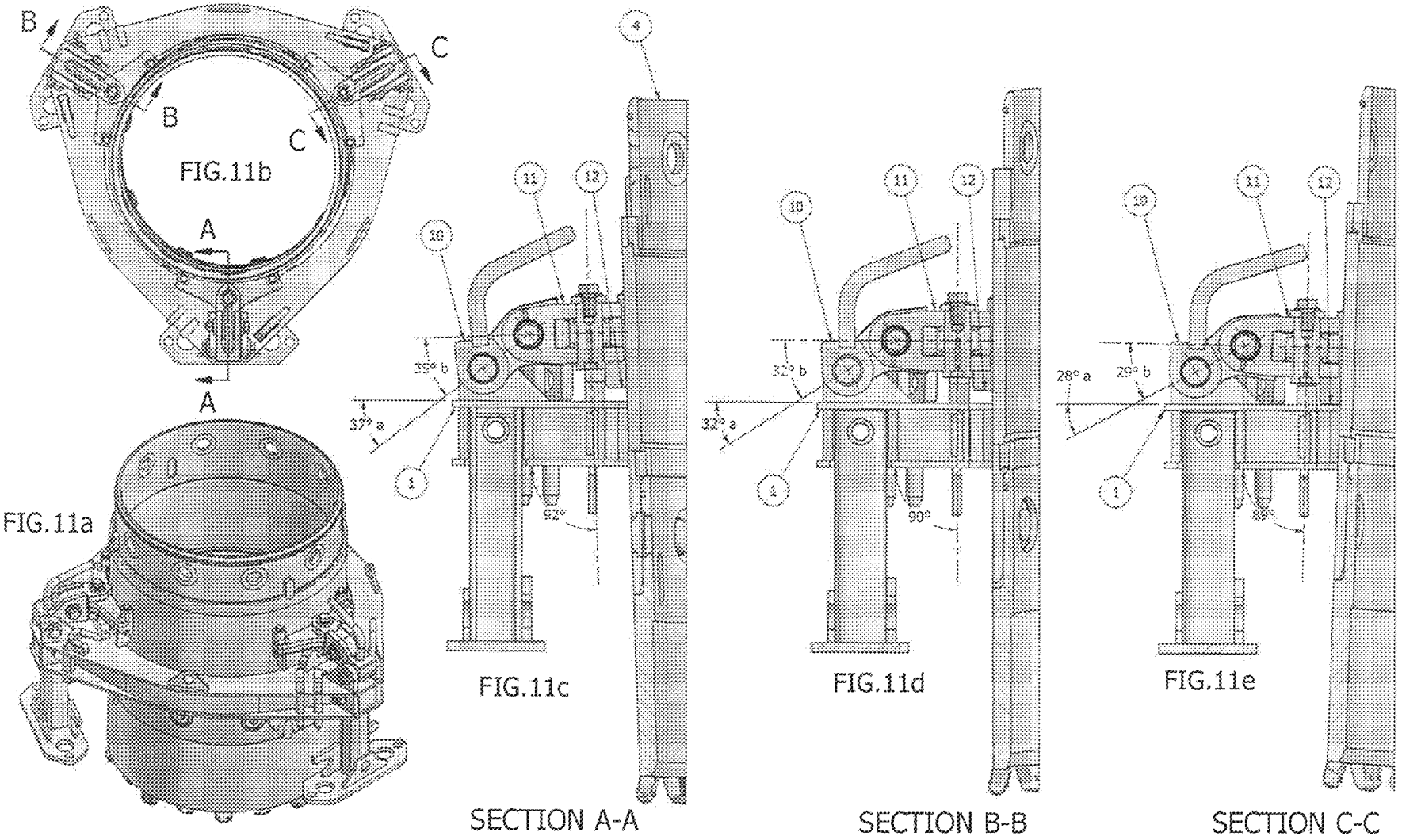
FIGS. 11*a*, 11*b*, 11*c*, 11*d* and 11*e* show perspective (same view as FIG. 2), top, and three sectional views (along reference lines A-A, B-B and C-C of FIG. 11*b*, respectively), of a three-arm embodiment of a guide/clamp assembly, shown with a misaligned sectional casing with male female jointed ends. Shown are cross sections of each (three) gripping arm in the closed position, showing the angular relationship between the present invention's mainframe 1, and links 10 and 11.

FIGS. 9*a* and 9*b* show perspective and top views of a three-arm embodiment of the guide/clamp assembly, shown with a sectional casing with male/female joints and a casing shoe with carbide cutters. Shown are three gripping arms 2*a*, 2*b*, 2*c* in the open position and three spacer plates 26 in position and centralizing the sectional casing 4 to the guide/clamp assembly. The spacer plates 26 are equally spaced at 120 degrees, as are the open gripping arms 2*a*, 2*b*, 2*c* and legs 3. Referring to FIG. 9*c*, detail A, in the lower right-hand corner, shows clearance (approximately ⅛" with a new casing) exists between the spacer plates 26 and the casing's 4 outside diameter. Shown are legs 3 with the standard base plates. Two holes 3*a* in each base plate are used for staking the present invention to a reference position on the ground using 3 to 6 locating pins 31 which are stored in the mainframe in holes 1*c* when not in use. The spacer plates 26 are removed from the guide slots and stored in holding slots 1*b* in the mainframe 1 once the casing shoe has been forced and turned into the soil.

FIGS. 10*a*, 10*b* and 10*c* are top, sectional and perspective views of a three-arm embodiment of the guide/clamp assembly, shown with a sectional casing/shoe. Shown are three gripping arms, in the open position and two spacer plates 26 in their positioning slots. One spacer plate has not been installed (stored in mainframe) as shown in Detail B (FIG. 10*d*) to show one of the three positioning slots "a" in the guide/clamp assemblies' mainframe 1. Spacer plate 26 consists of two parts, as shown in FIG. 10*c*. The spacer plate's body 27 has a radius on its front face that allows misalignment between the guide/clamp assembly and the casing as would be the case when working on uneven soil. Front-end personnel use handle 28 to install and remove the spacer plates. The spacer plate's body 27 is notched and fits into slot "a" while also contacting torque/stop plate 9. The notch fits over the torque/stop plates 9, locating the spacer plates 26 and preventing movement and damage, as the casing is forced, and turned, into the soil.

FIGS. 11*a*-11*e* are top, perspective (same view as FIG. 2) and three sectional views of a three-arm embodiment of the guide/clamp assembly, shown misaligned with a section casing/shoe. As noted, before, the guide/clamp assembly is generally misaligned as it generally sits on uneven soil, and/or slightly sinks into the soil. Shown are cross sections of each one of the three gripping arm in the closed position, against a casing/shoe, showing the angular relationship between the guide/clamp assemblies' mainframe 1, link 10, 11 and 12. With a misalignment between the guide/clamp assembly and the casing/shoe, the only gripping arm shown in the neutral position is at Section B-B (FIG. 11*d*) with both angles at 32 degrees as also seen in FIG. 5. In Section A-A (FIG. 11*c*), link 10 has rotated up to 37 degrees, while link 11 has rotated to 35 degrees. In Section C-C (FIG. 11*e*), link 10 has rotated down to 28 degrees, while link 11 has rotated to 29 degrees. Links 12 "y" and "z" axes rotation angles have also changed as they grip the casing as can be seen in Section C-C where link 12 is almost in contact with the main frame 1 top plate.

Figure 12:
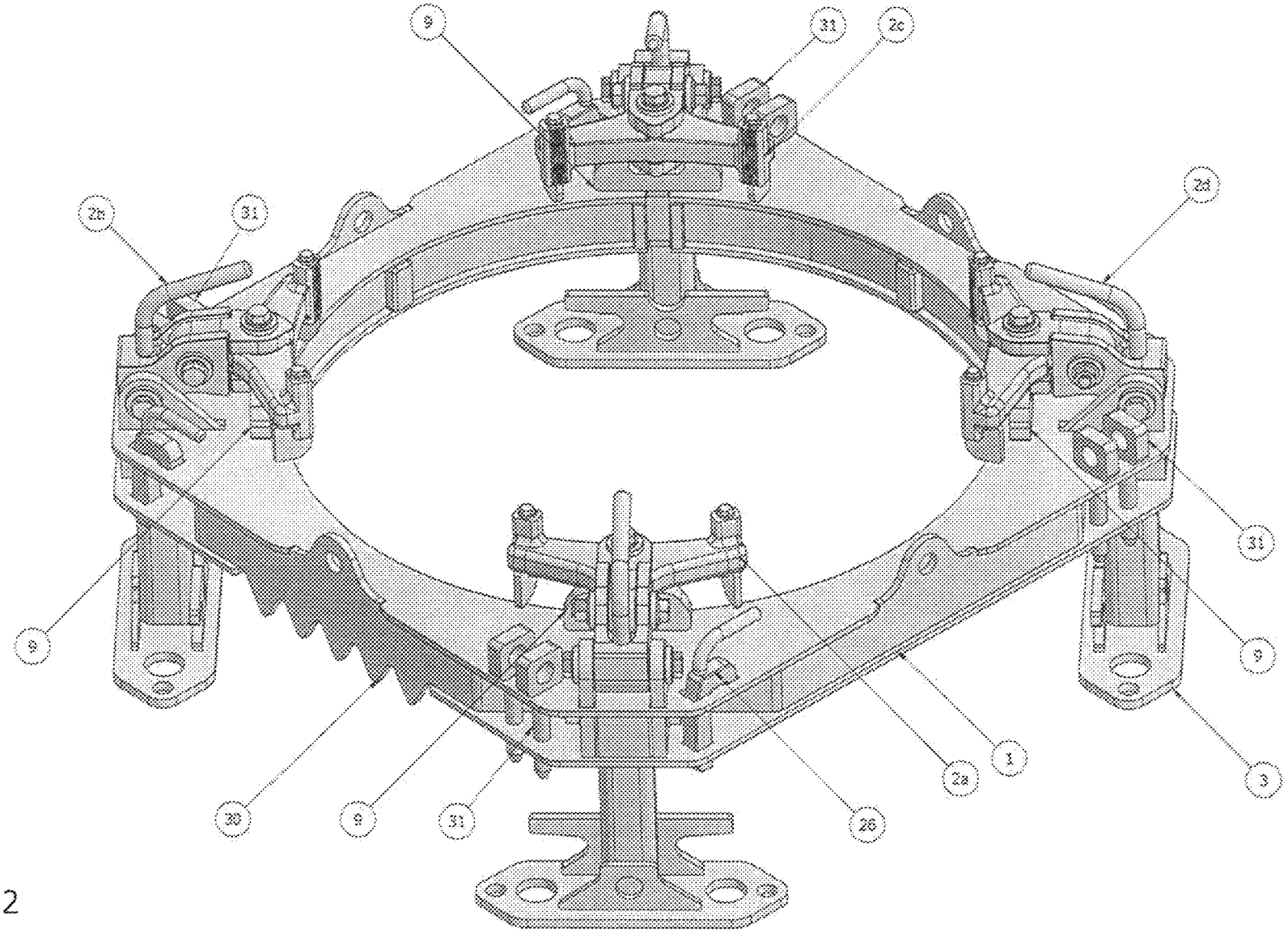
FIG. 12 is a perspective view of a four-arm embodiment of the guide/clamp assembly used for gripping 1300 mm diameter sectional casings and shown with gripping arms in the lowered (neutral) position.

FIG. 12 is a perspective view of a four-arm embodiment of the guide/clamp assembly, shown with gripping arms 2*a*, 2*b*, 2*c* and 2*d* in the lowered position and resting in torque/stop plates 9 (one per gripping arm). The four-arm embodiment of the guide/clamp assembly provides greater gripping capacity than the three-arm embodiment. However, the three-arm embodiment (FIG. 3) can work closer to obstructions such as building walls as the gripping arms can be fully opened, even if mainframe 1 is touching the wall.

Figure 13B:
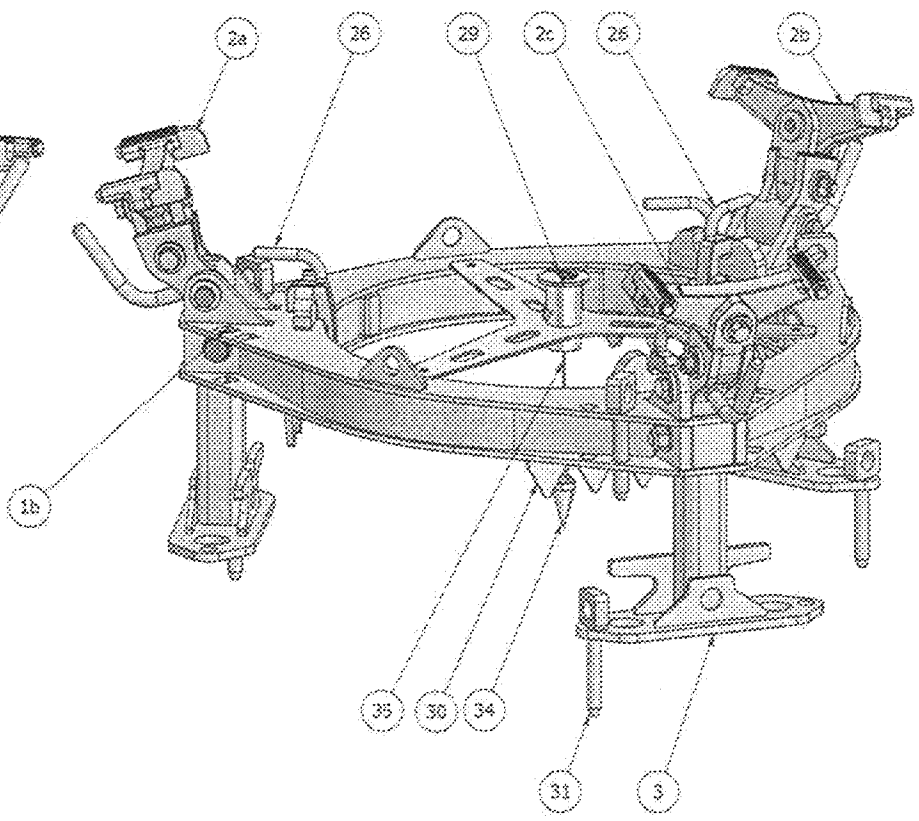
FIGS. 13*a* and 13*b* are perspective views (underside and topside, respectively) of a three-arm/embodiment of a guide/clamp assembly, shown with gripping arms in the open position and with the ground centralizer assembly (plumb bob type) in position.
Figure 13A:
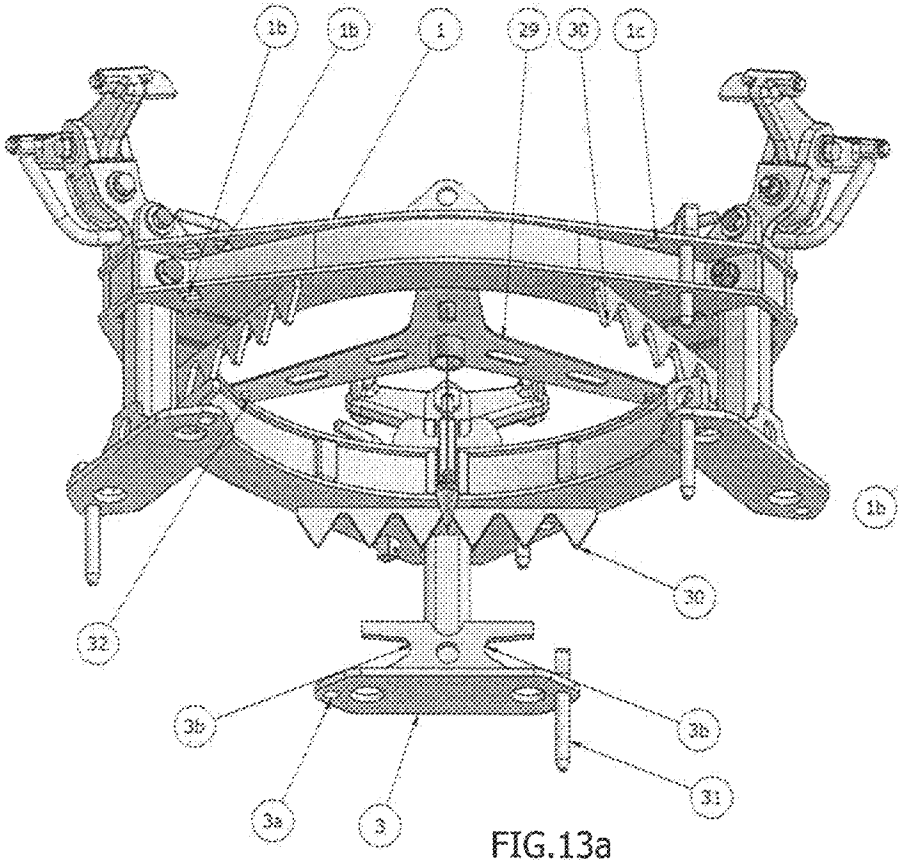

FIGS. 13*a* and 13*b* are two perspective views (underside and topside) of a three-arm embodiment of the guide/clamp assembly, and shown with gripping arms 2*a*, 2*b*, and 2*c* in the open position and with the ground centralizing assembly 29 in position. As mentioned above, the guide/clamp assemblies are designed to operate with legs (preferred) or without legs 3. Serrated cleats 30 are designed to bite into the ground and hold the guide/clamp assembly in position when the legs have been removed. In some soil condition the serrated cleats are enough to hold the guide/clamp assembly in position. Generally, the legs 3 are used with the locating pins 31 when the guide/clamp assembly is being used as a guide for the first section of casing fitted with the casing shoe. When not in use, the locating pins are stored in holding holes 1*c* in the mainframe 1.

The ground centralizing assembly 29 (also shown in FIG. 14) may be used to accurately position the guide/clamp assembly to a fixed reference point that has been marked out on the ground (normally a surveyed reference point). The ground centralizing assembly 29 sits on top of the guide/clamp assemblies' mainframe 1 and requires no fasteners or tools for attachment. Three equally spaced, tapered locating pins 32 (FIG. 14) are pressed into the aluminum body 33 of the ground centralizer and fit down snugly inside of the mainframe's top plate and use the inner diameter as a centering reference. The three pins 32 provide a self-centering action for ground centralizing assembly 29. Plumb bob 34 is attached to woven wire rope 35 and is used to centralize the ground centralizing assembly 29 to a fixed ground reference point. Guide/clamp assembly 100 may be lifted into position with the ground centralizing assembly with the plumb bob located over the fixed ground reference point. The guide/clamp assemblies' legs 3 have inner stiffener plates with cut outs 3*b*. A crowbar can be placed in the cutouts and into the soil to accurately position (lever) the guide/clamp assembly if minor, final positioning is required. Once the guide/clamp assembly has been accurately positioned, (plumb bob's point located directly over a fixed ground reference point), the two holes 3*a* in each base plate can be used for staking the guide/clamp assembly to the ground using 3-6 locating pins 31. A sledgehammer may be used to drive the pins into the soil while extraction of the pins from the soil is accomplished when the guide/clamp assembly is lifted. The base plates on legs 3 pull the pins from the soil by contacting the underside of a pin's head. One pin in each base plate is generally all that is required in good footing, with more pins being driven in poor footing. If the locating pins 31 are not appropriate, pads with spikes or cleats can also be bolted onto the original base plates using the two 3*a* holes. The spacer plates 26 are removed from the guide slots and stored in holding slots 1*b* in the mainframe 1 once the casing shoe has been forced and turned into the soil. The guide/clamp assembly can remain in place or can be removed once the first section of casing/shoe is turned into the soil.

Figures 14A, 14B, 14C:
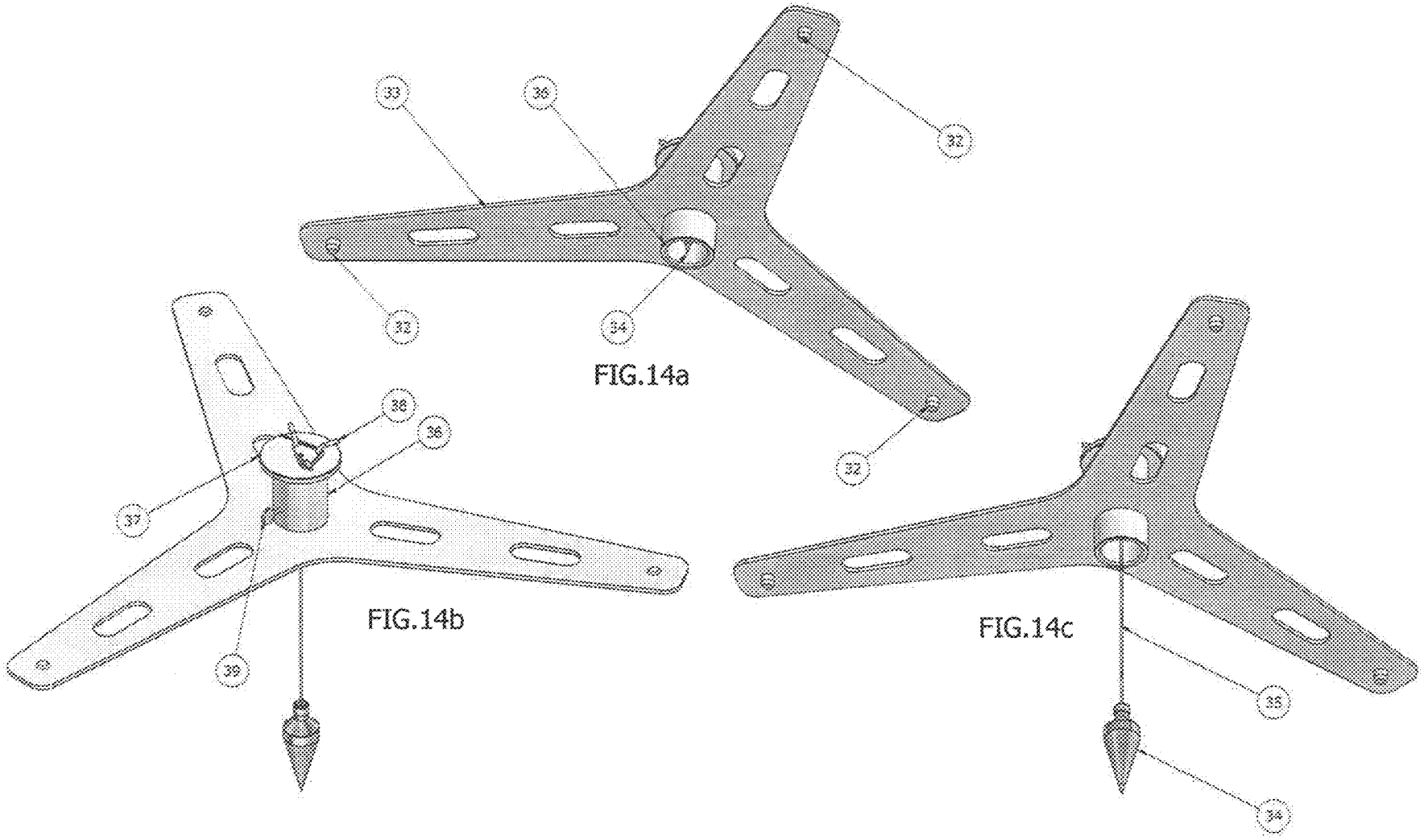
FIGS. 14*a*, 14*b* and 14*c* are perspective views
Figure 15B:
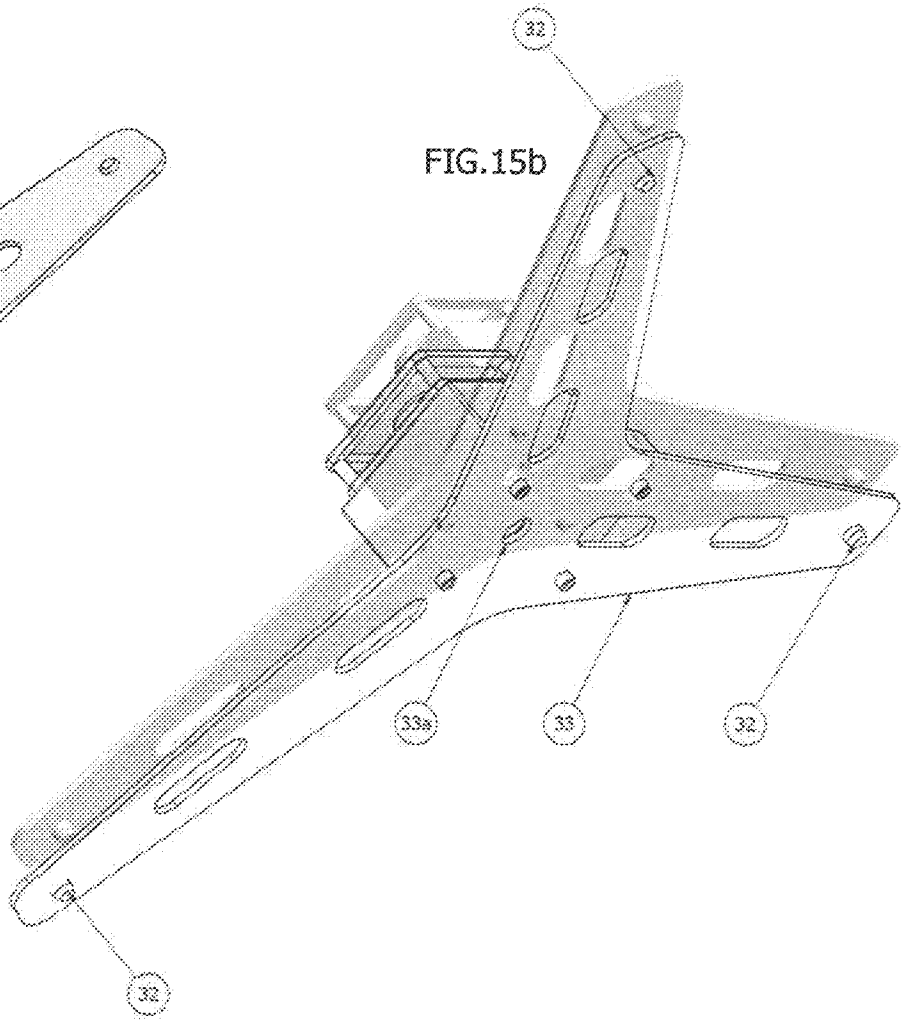
FIGS. 15*a* and 15*b* are perspective views (topside and underside, respectively) of the ground centralizer assembly fitted with a self-leveling laser. The components in the drawings are not necessarily to scale, emphasis instead being placed upon dearly illustrating the principles of the present invention. In the drawings, like reference numerals designate corresponding parts throughout the several views.
Figure 15A:
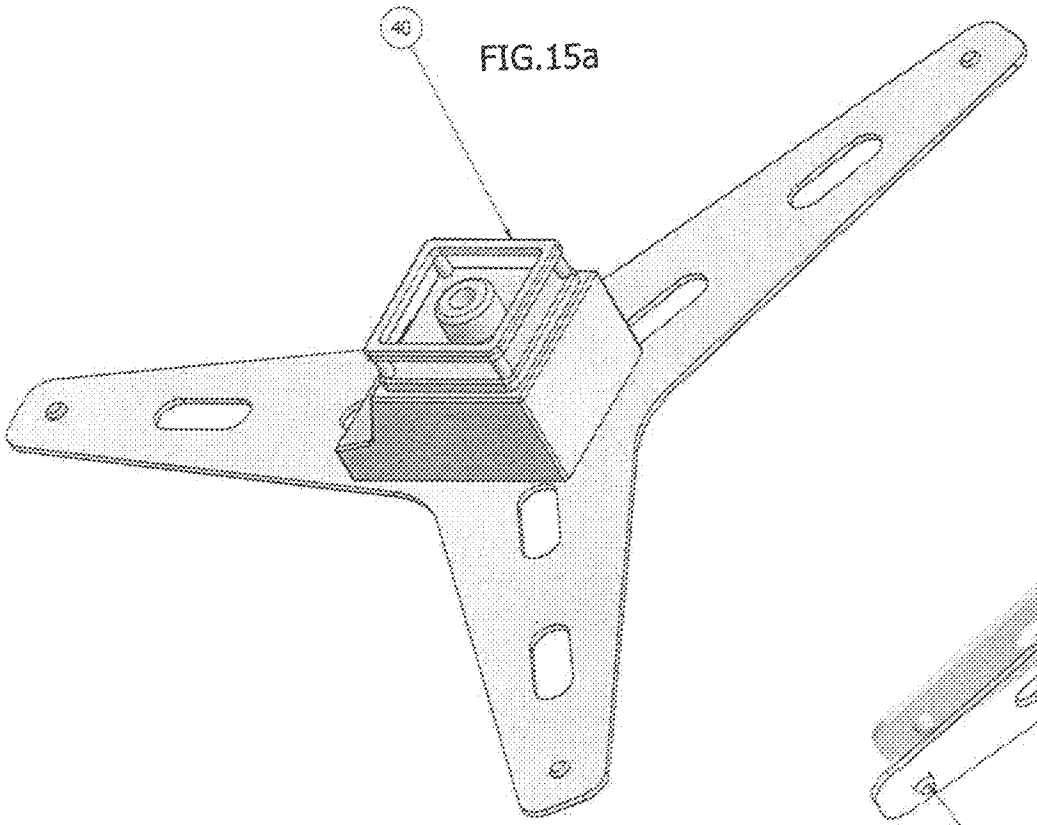

FIGS. 14*a*-14*c* are three perspective views (two underside, one topside) of a three-arm embodiment of the ground centralizing assembly 29. Aluminum body 33 has a tubular housing 36 and a housing top plate 37 with a central hole through which a flexible woven wire rope passes. Attached to the top plate 37 are the retention arms 38 (cleats) to which the wire rope is wound around and retained. The length of the wire rope can be varied to adjust the plumb bob's height in relation to the ground reference point. Thumb screw 39 is located in the tubular housing 36 and is used to retain the plumb bob in the housing when it is not being used, as shown in FIG. 14*a*. 6061 aluminum was chosen for the body, housing and top plate, and keeps the assembly weight down to approximately 12 lbs for easy handling by one person.

FIGURE shows another adaption of the ground centralizing assembly where the plumb bob assembly is replaced by self levelling-laser 40 mounted to aluminum body 33. The laser beam exits through hole 33*a* onto a fixed ground reference point to which the guide/clamp assembly will be aligned.

The advantages of the plumb bob adaption over the laser are: no batteries are required; can be used in bright daylight; simple and robust construction; and less chance of being stolen.

The above description is not intended to limit the meaning of the words used in the following claims that define the invention. Persons of ordinary skill in the art will understand that a variety of other designs still falling within the scope of the following claims may be envisioned and used. It is contemplated that these additional examples, as well as future modifications in structure, function, or result to that disclosed here, will exist that are not substantial changes to what is claimed here, and that all such insubstantial changes in what is claimed are intended to be covered by the claims.

I claim:

1. An apparatus for use in positioning, guiding and then clamping a tubular casing used to produce a borehole, comprising:

a mainframe having an opening for receiving the tubular casing, the mainframe surrounding the casing and carrying a guide and clamp assembly comprising slots equally spaced around the opening, the slots being configured to receive spacer plates for use in centralizing the tubular casing within the opening;

wherein, the spacer plates facilitate accurate positioning of the casing and prevent the casing from wandering when the casing is initially turned and forced into soil, and the spacer plates also provide limited oscillation with an outer surface of the casing in all planes to counteract misalignment between the mainframe and the casing: and wherein, to hold a casing during its extraction from the borehole, the guide and clamp assembly further comprises a plurality of gripping arms carried by the mainframe for use in gripping the outer surface of the casing in all planes to counteract misalignment between the mainframe and the casing.

2. The apparatus of claim 1, wherein the gripping arms are pivotable about pivot pins, and wherein corresponding stop plates support the gripping arms, and the stop plates reduce stresses on the pivot pins when the casing undergoes axial loads.

3. The apparatus of claim 1, wherein the mainframe carries lifting plates equally spaced around the mainframe, and wear pads equally spaced a around inside portions of the mainframe adjacent the opening.

4. The apparatus of claim 1, wherein each spacer plate comprises a handle, a notch and a curved front face that can be fitted into a corresponding guide slot in the mainframe, allowing the spacer plates to be used to centralize a misaligned casing within the opening relative to the mainframe.

5. The apparatus of claim 1, wherein the mainframe comprises removeable legs and cleats, and wherein the cleats enable e mainframe to sit directly on soil with the legs removed.

6. The apparatus of claim 1, wherein the mainframe comprises legs with a flat pad with holes for pinning or bolting cleats or spiked pads, or accepting retaining pins, that are driven into soil.

7. The apparatus of claim 1, wherein the gripping arms are equally spaced around the opening and able to independently rotate in the "x", "y" and "z" axes.

8. The apparatus of claim 7, wherein the gripping arms are able to frictionally grip a portion of an aligned or misaligned casing, and automatically release the grip when the casing is to be raised.

9. The apparatus of claim 7, wherein the gripping arms can be manually opened, allowing spacer plates to be located within mainframe slots.

10. The apparatus of claim 1, wherein the gripping arms are equally-spaced about the opening, and the gripping arms are positioned in-line with support legs, and further comprising stop plates which limit a closed position of the gripping arms.

11. The apparatus of claim 1, wherein the gripping arms automatically increase their grip on a casing as the vertical load on the casing is increased.

12. The apparatus of claim 1, further comprising a plurality of gripping arm assemblies, each assembly being pivotally attached to the mainframe by a removable pin and pivoting around the "x" axis.

13. The apparatus of claim 12, wherein each gripping arm assembly comprises a spherical bearing and three links working and pivoting together in the "x, "y" and "z" axes.

14. The apparatus of claim 12, wherein each gripping atm assembly comprises a spherical bearing and two links working and pivoting together in the "x" axis.

15. The apparatus of claim 12, wherein each gripping arm assembly comprises a spherical bearing and two links working and pivoting together in the "y" and "z," axes.

16. The apparatus of claim 12, wherein each gripping arm assembly comprises a first and a second gripping arm link with mechanical stops, limiting "x" axis rotation.

17. The apparatus of claim 16, wherein each gripping arm assembly comprises a third gripping arm link with mechanical stops, limiting "y" and "z" axis rotation.

18. The apparatus of claim 17, wherein the third gripping arm link comprises replaceable spherical bearings and spacer with stops to prevent "x" axis rotation.

19. The apparatus of claim 18, wherein the third gripping arm link comprises elastomeric elements used to resist "z" axis rotation and to protect the spherical bearing from contamination and aid grease retention, and replaceable gripping dies.

20. The apparatus of claim 1, further comprising a ground centralizing assembly for the mainframe that is self-centralizing and can be aligned to a fixed ground reference point using a plumb bob or self aligning laser.

21. A method for positioning, guiding and then clamping a tubular casing used to produce a borehole, comprising the steps of:

positioning a mainframe having an opening for receiving the tubular casing, the mainframe surrounding the casing and carrying a guide and clamp assembly comprising: (a) slots equally spaced around the opening and configured to receive spacer plates for use in centralizing the tubular casing within the opening; and (b) a plurality of gripping arms for selectively clamping onto the casing turning the casing and forcing the casing into soil, while using the spacer plates to guide placement of the casing and to prevent the casing from wandering, wherein during the placement and turning of the casing the s laws a provide limited oscillation with an outer surface of the casing in all planes to counteract misalignment between the mainframe and the casing; and extracting the casing from the borehole, using the gripping arms to grip the outer surface of the casing in all planes to counteract misalignment between the mainframe and the casing.

22. The method of claim 21, wherein after casings are attached together to form a casing string, and the casing string is driven into soil and cement is poured into the casing string, further comprising the step of serially extracting sections of the casing string from the soil by first clamping the guide and clamp assembly of the mainframe onto the casing string at a position below a joint of the casing string to prevent the casing string from slipping back into the borehole under its own weight, removing a portion of the casing string above the joint, and then repeating this extraction process for further sections of the casing string.

23. The method of claim 21, further comprising the step of centralizing the casing within the mainframe by aligning the casing to a fixed ground reference point using a plumb bob or self-aligning laser.

* * * * *